US008967226B2

(12) United States Patent
Vestal

(10) Patent No.: US 8,967,226 B2
(45) Date of Patent: Mar. 3, 2015

(54) ARCHITECTURAL COVER OPERATING ASSEMBLY

(75) Inventor: William D. Vestal, Burlington, NC (US)

(73) Assignee: Safe-T-Shade, Huntersville, NC (US)

( * ) Notice: Subject to any disclaimer, the term of this patent is extended or adjusted under 35 U.S.C. 154(b) by 817 days.

(21) Appl. No.: 12/976,677

(22) Filed: Dec. 22, 2010

(65) Prior Publication Data

US 2011/0146429 A1 Jun. 23, 2011

Related U.S. Application Data

(60) Provisional application No. 61/289,479, filed on Dec. 23, 2009, provisional application No. 61/297,659, filed on Jan. 22, 2010, provisional application No. 61/300,432, filed on Feb. 1, 2010, provisional application No. 61/411,342, filed on Nov. 8, 2010.

(51) Int. Cl.

| | |
|---|---|
| ***A47H 1/00*** | (2006.01) |
| ***E06B 9/326*** | (2006.01) |
| ***E06B 9/262*** | (2006.01) |

(52) U.S. Cl.

CPC ..... *E06B 9/326* (2013.01); *Y10T 29/49826* (2015.01); *Y10T 74/18832* (2015.01); *E06B 9/262* (2013.01); *E06B 2009/2622* (2013.01)

USPC ..... 160/321

(58) Field of Classification Search

USPC ..... 160/321, 319, 309, 193, 307, 320, 160/178.1 R, 344, 168.1 R, 173 R, 176.1 R, 160/177 R

See application file for complete search history.

(56) References Cited

U.S. PATENT DOCUMENTS

| | | | | |
|---|---|---|---|---|
| 2,410,549 A | | 11/1946 | Olson | |
| 2,557,877 A | | 6/1951 | Kluson | |
| 2,577,046 A | * | 12/1951 | Svirsky | 160/321 |
| 3,022,819 A | * | 2/1962 | Lampret | 160/345 |
| 3,633,646 A | | 1/1972 | Zilver | |
| 3,795,267 A | | 3/1974 | Debs | |

(Continued)

FOREIGN PATENT DOCUMENTS

| | | |
|---|---|---|
| CA | 2201209 A1 | 9/1998 |
| FR | 2785639 A1 | 5/2000 |

OTHER PUBLICATIONS

Non-final Office Action for U.S. Appl. No. 13/738,387 mailed May 13, 2013, 15 pages.

(Continued)

*Primary Examiner* — Katherine Mitchell
*Assistant Examiner* — Johnnie A Shablack
(74) *Attorney, Agent, or Firm* — Withrow & Terranova, PLLC

(57) ABSTRACT

A single or dual channel cord enclosure adapted to hide at least a portion of a cord drawing a shade or blind up or down is included as part of an apparatus, which may also include a roller mechanism adapted to drive a roller to operate an architectural cover, and a cord mechanism adapted to drive the roller mechanism. The enclosure may completely enclose the cord and utilize a slider to actuate the cord within the cord channel enclosure. In another embodiment, an apparatus for actuating an architectectural covering includes an enclosure configured to receive a cord mechanism; a roller mechanism provided on an end of the enclosure; and a slider configured to be movably engaged to the enclosure so that moving the slider actuates the roller mechanism to lift or lower the architectural covering. Also included is a method of making an apparatus for actuating an architectectural covering.

46 Claims, 28 Drawing Sheets

(56) References Cited

U.S. PATENT DOCUMENTS 4,685,502 A * 8/1987 Spangenberg ..... 160/107
4,807,683 A 2/1989 Hennequin et al.
4,817,698 A * 4/1989 Rossini et al. ..... 160/107
4,865,108 A 9/1989 Hennequin et al.
4,865,109 A 9/1989 Sherman
5,273,096 A 12/1993 Thomsen et al.
5,465,775 A 11/1995 Biba et al.
5,465,779 A 11/1995 Rozon
5,472,035 A 12/1995 Biba et al.
5,501,262 A 3/1996 Inaba et al.
5,513,687 A 5/1996 Tuzmen et al.
5,553,649 A 9/1996 Chisaka et al.
5,553,653 A 9/1996 Rozon
5,595,232 A 1/1997 Benthin
5,645,685 A 7/1997 Furhman
5,657,807 A 8/1997 Hsu
5,671,793 A 9/1997 Lee
5,706,876 A 1/1998 Lysyj
5,709,258 A 1/1998 Coccoluto
5,722,478 A 3/1998 Claypool et al.
5,749,405 A 5/1998 Huang
5,752,558 A * 5/1998 Lin ..... 160/320
5,797,441 A 8/1998 Benthin
5,819,832 A 10/1998 Huang
5,850,863 A 12/1998 Huang
5,862,850 A 1/1999 Yang
5,904,198 A 5/1999 Huang
6,062,292 A 5/2000 Bryant
6,164,291 A 12/2000 Filippone
6,189,595 B1 2/2001 Lee
6,196,293 B1 3/2001 Lee
6,463,987 B1 10/2002 Nevins
6,477,748 B2 11/2002 Steiner
6,516,860 B1 * 2/2003 Weaver et al. ..... 160/168.1 R
6,591,461 B2 7/2003 Salentine et al.
6,601,633 B2 * 8/2003 Sun et al. ..... 160/107
6,644,374 B2 11/2003 Nien
6,680,594 B2 1/2004 Collett et al.
6,685,592 B2 * 2/2004 Fraczek et al. ..... 475/14
6,752,194 B1 6/2004 Huang
6,792,995 B2 9/2004 Judkins
6,817,399 B2 11/2004 Berman et al.
6,948,216 B2 9/2005 Gaudyn et al.
7,036,547 B1 5/2006 Cheng et al.
7,117,920 B2 10/2006 Dekker et al.
7,124,801 B2 10/2006 Ng et al.
7,204,292 B2 4/2007 Nien
7,261,138 B2 8/2007 Judkins et al.
7,464,742 B2 12/2008 Oskam et al.
7,597,131 B2 10/2009 Nien et al.
7,624,784 B2 12/2009 Anthony et al.
7,669,633 B2 * 3/2010 Berger ..... 160/107
7,770,625 B2 8/2010 Lukos
7,775,254 B2 8/2010 Judkins et al.
7,832,450 B2 11/2010 Brace et al.
7,938,161 B2 5/2011 Lin
8,091,606 B2 1/2012 Nien et al.
8,113,261 B2 2/2012 Lin
8,220,517 B2 7/2012 Kollman et al.
8,256,489 B2 * 9/2012 Berger ..... 160/107
8,267,144 B2 9/2012 Hsu et al.
8,281,842 B2 10/2012 Lin
8,286,686 B2 * 10/2012 Cannaverde ..... 160/320
8,291,959 B2 10/2012 Cheng
8,316,911 B2 11/2012 Cleaver
8,356,653 B2 1/2013 Fu-Lai et al.
8,365,362 B2 2/2013 Chou
8,381,792 B2 2/2013 Perkowitz
8,474,509 B2 * 7/2013 Koop ..... 160/321
8,499,815 B2 * 8/2013 Zhang ..... 160/176.1 R
8,511,363 B2 8/2013 Lin
8,544,525 B2 * 10/2013 Zhu ..... 160/321
8,550,141 B2 * 10/2013 Ding ..... 160/107
8,763,675 B2 7/2014 Zhu
2003/0192654 A1 10/2003 Nien
2003/0192655 A1 10/2003 Nien
2003/0201076 A1 10/2003 Nien
2004/0003900 A1 1/2004 Nien
2004/0108080 A1 * 6/2004 Nien ..... 160/173 R
2004/0200583 A1 10/2004 Nien
2005/0109468 A1 5/2005 Hsu
2006/0157204 A1 7/2006 Lin
2006/0243402 A1 * 11/2006 Chang ..... 160/321
2007/0023149 A1 2/2007 Lamars et al.
2007/0235147 A1 10/2007 Zakowski et al.
2008/0083511 A1 * 4/2008 Hung ..... 160/168.1 R
2009/0071610 A1 3/2009 Bossler
2010/0101741 A1 * 4/2010 Koop ..... 160/321
2010/0126673 A1 5/2010 Lin
2010/0126674 A1 5/2010 Lin
2010/0126679 A1 5/2010 Lin
2010/0193141 A1 8/2010 Liang et al.
2010/0212120 A1 8/2010 LeBlanc
2010/0269984 A1 10/2010 Hanley et al.
2010/0269985 A1 10/2010 Hanley et al.
2010/0294438 A1 11/2010 Kirby et al.
2010/0326608 A1 12/2010 Wen et al.
2011/0036512 A1 2/2011 Su
2011/0048652 A1 3/2011 Chen
2011/0056633 A1 3/2011 Lin
2011/0067820 A1 3/2011 Hsu et al.
2011/0073260 A1 3/2011 Kollman et al.
2011/0083816 A1 4/2011 Chen
2011/0107557 A1 5/2011 Bourke et al.
2011/0108206 A1 5/2011 Hsu et al.
2011/0132554 A1 6/2011 Lin
2011/0168339 A1 * 7/2011 Bowen et al. ..... 160/268.1
2011/0192549 A1 8/2011 Wen et al.
2011/0192550 A1 8/2011 Williams
2011/0192557 A1 8/2011 Ling
2011/0247761 A1 10/2011 Lin
2011/0247762 A1 10/2011 Lin
2011/0247763 A1 10/2011 Hu et al.
2011/0247765 A1 10/2011 Lin
2011/0297336 A1 12/2011 Chen
2011/0297337 A1 12/2011 Chen
2012/0067527 A1 3/2012 Cheng
2012/0097342 A1 4/2012 Tu
2012/0097343 A1 * 4/2012 O'Hair ..... 160/168.1 R
2012/0267056 A1 10/2012 Ko
2012/0285634 A1 11/2012 Zhu
2013/0068405 A1 * 3/2013 Lava et al. ..... 160/321

OTHER PUBLICATIONS

Non-Final Office Action for U.S. Appl. No. 13/094,727, mailed Apr. 10, 2013, 13 pages.
Final Office Action for U.S. Appl. No. 12/976,732, mailed Jun. 25, 2013, 16 pages.
First Examination Report for New Zealand patent application 610332 mailed May 10, 2013, 2 pages.
International Preliminary Report on Patentability for International patent application PCT/US2010/062057 mailed Jul. 4, 2013, 14 pages.
Final Office Action for U.S. Appl. No. 13/035,222 mailed Jul. 17, 2013, 5 pages.
Final Office Action for U.S. Appl. No. 13/094,705 mailed Jul. 18, 2013, 6 pages.
Notice of Allowance for U.S. Appl. No. 13/738,387 mailed Jul. 10, 2013, 9 pages.
Non-final Office Action for U.S. Appl. No. 12/976,732 mailed Nov. 19, 2012, 14 pages.
Non-final Office Action for U.S. Appl. No. 13/035,222 mailed Jan. 2, 2013, 6 pages.
Non-final Office Action for U.S. Appl. No. 13/094,705 mailed Jan. 14, 2013, 6 pages.
International Search Report for PCT/US2011/026410 mailed May 3, 2012, 13 pages.
International Search Report for PCT/US2012/034984 mailed Jul. 13, 2012, 9 pages.
International Search Report for PCT/US2012/034990 mailed Jul. 20, 2012, 9 pages.

(56) References Cited

OTHER PUBLICATIONS

Non-final Office Action for U.S. Appl. No. 13/094,727 mailed Aug. 29, 2012, 19 pages.
International Search Report for International patent application PCT/US2010/062057 mailed Oct. 27, 2011, 20 pages.
Non-final Office Action for U.S. Appl. No. 12/976,732 mailed Dec. 18, 2013, 12 pages.
International Preliminary Report on Patentability for PCT/US2012/034984 mailed Nov. 7, 2013, 7 pages.
International Preliminary Report on Patentability for PCT/US2012/034990 mailed Nov. 7, 2013, 7 pages.
Non-final Office Action for U.S. Appl. No. 13/094,727 mailed Nov. 25, 2013, 10 pages.
Extended European Search Report for European patent application 13166761.0 mailed Apr. 1, 2014, 11 pages.
Final Office Action for U.S. Appl. No. 13/094,727 mailed Jul. 17, 2014, 12 pages.
Final Office Action for U.S. Appl. No. 13/035,222, mailed Oct. 1, 2014, 6 pages.
Non-final Office Action for U.S. Appl. No. 13/035,222 mailed Apr. 17, 2014, 7 pages.
Non-Final Office Action for U.S. Appl. No. 13/094,705, mailed May 29, 2014, 6 pages.
Notice of Allowance for U.S. Appl. No. 12/976,732, mailed May 1, 2014, 8 pages.
Final Office Action for U.S. Appl. No. 13/094,705 mailed Oct. 28, 2014, 9 pages.
Non-Final Office Action for U.S. Appl. No. 14/021,181 mailed Oct. 30, 2014, 8 pages.
Notice of Allowance and Applicant-Initiated Interview Summary for U.S. Appl. No. 13/094,727 mailed Oct. 31, 2014, 9 pages.

* cited by examiner

ARCHITECTURAL COVER OPERATING ASSEMBLY

This application claims the benefit of provisional patent application Ser. No. 61/289,479, entitled "Cordless Covering For Architectural Opening", filed Dec. 23, 2009, and provisional patent application Ser. No. 61/297,659, "Cordless Covering For Architectural Opening", filed Jan. 22, 2010, and provisional patent application Ser. No. 61/300,432, entitled "Cordless Covering For Architectural Opening", filed Jan. 22, 2010, and provisional patent application Ser. No. 61/411,342, entitled "Cordless Covering For Architectural Opening", filed Nov. 8, 2010, the disclosures of which are hereby incorporated herein by reference in their entireties.

This application is also related to copending U.S. patent application Ser. No. 12/976,732, filed Dec. 22, 2010, entitled "Cordless Covering for Architectural Opening", which is incorporated herein by reference in its entirety.

FIELD OF THE DISCLOSURE

Embodiments disclosed herein include cordless window and architectural passage coverings. In particular, in one embodiment, a covering incorporates a separate sheet of material attached at one end to a roller, and at the other end to the covering, whereby the sheet of material extends and retracts the covering from an architectural passage. Moreover, in one embodiment, guide members may be attached to a covering by which the separate sheet of material passes through such guide members, wherein as the sheet is drawn upwards through the guide members, the guide members stack in an accordion fashion and raise the covering upwardly into folded layers of a roman shade. Additionally, in one embodiment, a pull cord guide that can be retro fitted to existing shades to avoid having a hazardous loop is disclosed.

BACKGROUND

In the use of window and architectural passage coverings, the art has long relied on cords, string or the like to extend and retract the coverings. Such coverings take many forms, including shades such as curtains, roll-up shades, Venetian blinds, vertical blinds, cellular shades, and the like. The problem with such coverings that rely on cords is that small children can become entangled in the cords and experience serious harm, including strangulation and death. On Aug. 26, 2009, the U.S. Consumer Product Safety Commission announced a voluntary recall of all ¼ inch Oval Roll-up Blinds and Woolrich Roman Shades, including some 4.2 million roll-up blinds and 600,000 Roman shades, (http://www.cpsc.gov/cpscpub/prerel/prhtml09/09324.html). The Commission referenced the hazard that "[s]trangulations can occur if the lifting loops slide off the side of the blind and a child's neck becomes entangled on the free-standing loop or if a child places his/her neck between the lifting loop and the roll-up blind material." Recent cited injuries include a report that "[i]n November 2007, a 1-year-old boy from Norridgewock, Me. became entangled and strangled in the lift cord loop of a roll-up blind that had fallen into his portable crib. In October 2008, a 13-month-old boy from Conway, Ark. was found with his head between the exposed inner cord and the cloth on the backside of a Roman shade. The cord was not looped around the boy's neck but rather ran from ear to ear and strangled the child." Numerous manufacturers and retailers have followed their call. Additional information may be found at: (http://www.windowcoverings.org).

In addition to the internal cords attached to the shade or blinds that can be pulled out and pose a problem, the pull cords, string and beaded cords in mechanical based blinds and shades that are pulled on to draw up the blinds or shades also pose a risk since they also create a hazardous loop of sufficient diameter (12 inches per the Consumer Product Safety Commission) for a small child to get their head tangled inside. Even the retrofit devices currently available (http://www.windowcoverings.org/how_to_retrofit.html) do not eliminate the hazardous loops created by the beaded cords even if they are tied to the wall with a tie-down device such as a Rollease™ product or with separated draw strings and/or cord stops that could still become tangled together to create a hazardous loop.

U.S. Pat. No. 7,624,784 to Anthony, et al. (hereinafter "Anthony") discloses a segmented roll-up covering with a plurality of roller assemblies utilized to form panels wherein each roller assembly includes a strip of flexible lift sheet material and an associated roller about which the material can be wrapped. One edge of the lift sheet material is fixed to a relatively rigid bar or is otherwise supported while the opposite edge is secured to its associated roller. The roller with the lift sheet material secured thereto is cradled in one of a plurality of cradles provided in a first lift system which includes a cord ladder or similar structure so that upon movement of one vertical run of the cord ladder between an elevated and a lowered position while the other vertical run remains stationary, the cradle is raised or lowered thereby lifting or lowering the roller causing it to roll and either roll the fabric thereabout or unroll the fabric there from depending upon the direction of rotational movement of the roller. One problem with this system is that the lift system is enabled by a cord ladder, which as mentioned above, can pose a danger to small children.

There have been attempts to create cordless coverings in the art. One example is U.S. Pat. No. 7,036,547 to Cheng, et al. (hereinafter "Cheng") discloses an assembly that includes a shade capable of height adjustment, comprising a shade with multiple pleats, a roller, a strap that extends through multiple pleats of the assembly, and at least one strap operatively connected with the roller to be raised and lowered as the height of the shade is increased or decreased. While Cheng discloses a cordless lift mechanism, the lift mechanism disclosed involves straps or narrow ribbons of fabric that would not reduce the strangulation risk to a child. In addition, the straps are threaded through the shade, exposing holes by which light can pass through the shade. Moreover, the straps are not sufficient to hold heavy shades, curtains and the like.

U.S. Published Patent Application No. 20050109468 to Hsu (hereinafter "Hsu") discloses a cordless blind structure that includes a blind body attached to the underside of an upper beam, and a plurality of magnet components of elongated bars or blocks equidistantly distributed from the bottom-most slat upward to the top of the blind body. Hsu's system includes magnet components fixed to the outer surface of the blind body that acts as a cordless lift mechanism wherein the magnet components are consecutively lifted upwards and sequentially piled up in order to fold up the slats of the blind body. To unfold the blind body, the blind body is pulled slightly downwards by the bottom-most slat to detach the engaged magnet components from one another, releasing the collected blind body to suspend downwards. One drawback to the system of Hsu is the requirement of having expensive and likely heavy magnets capable of holding the weight of the blind or sacrificing weight for security that precludes the use of such system with heavier coverings such as shades, curtains and the like. Moreover, the system of Hsu fails to include guiding members to assure that the blind is folded properly.

U.S. Pat. No. 5,706,876 to Lysyj (hereinafter "Lysyj") discloses a cordless, cellular window shade that uses a conventional roller shade bar to raise and lower transversely spaced tapes that extend through slits in the cellular fabric and are secured to the bottom rail of the shade. The deficiencies of the Cheng shade assembly are also present in the shade disclosed in Lysyj.

U.S. Pat. No. 5,273,096 to Thomsen et al. (hereinafter "Thomsen") discloses an apparatus for gripping lengths of sheet material in a foldable blind or shade, in a blind that is composed of one continuous piece of fabric. Tubular members having longitudinal openings therein which accept the sheet material through grooves are described. Rod members also fit within the tubular members, to hold the sheet material between the tubular members and the rod members. Guide means are arranged to guide pull cords, and engage a longitudinal groove in each tubular member. Thomsen discloses a powered lift mechanism, but only exemplifies shades that include corded lift mechanisms that do not eliminate the risk of strangulation.

In consequence, the art is in need of improvement in coverings for architectural openings that maintains the functionality and aesthetics of previously developed coverings, but avoids their deficiencies, particularly their hazardous character as regards the risk of injury or death associated with the use of cord arrangements. The art also is in need of a new mechanism to drive the lifting mechanism of shades and blinds that avoids creating a hazardous loop.

SUMMARY

Embodiments disclosed in the present description relate to cordless coverings for an architectural opening, such as a window, door, portal, or the like. In one embodiment, a cord loop enclosure for shades and blinds is disclosed and is configured to replace the looped beaded cords pull cords, and strings that drive a rolling mechanism to draw up the blinds or shade.

In one embodiment, a shade with a cordless lift mechanism is disclosed that comprises a roller, guide members or looped bars, and an inner and outer material, e.g., fabric material. In another aspect, the material can comprise any woven or non woven sheet or web of lift sheet material, or film or sheet material, with the first inner lift sheet material connected at one end to the roller and at the other end engaged in some manner to the outer material.

In one embodiment, the second outer material or decorative shade itself is secured at an upper end portion to a support member. The support member can be any well known construction of material that houses a rolling mechanism to draw up the shade, e.g., wherein the support member is attached to a wall above an architectural opening. The support member can for example comprise a box or rectangular-shaped panel that is covered with decorative fabric matching that of the shade or second material.

In various further implementations, the first or inner material behind the shade is generally hidden from view and is engaged with the bottom of the shade material, such that the first guide or lift sheet material is drawn up by the roller, thereby pulling from the bottom the bottom of the shade material. Alignment may be maintained during the raising and lowering of the shade by the use of guide members that can be attached to the shade, which maintain alignment and also allow for pleated stacking of the shade as the inner lift sheet material pulls on the bottom of the shade material, but which itself has its movement restricted to being close to the shade material by the guide members. As the lift sheet material is drawn up, the guide members that enclose the lift sheet material may be sequentially spaced along the shade material and begin stacking together to force the shade material to fold like an accordion as the shade is drawn up.

A further aspect to a cordless lift system comprising a monitoring assembly adapted to stop the first material from being wound about the roller, when stress, load or strain exceeding a predetermined value is sensed by the monitoring assembly as being exerted on a location or component of the covering.

In another aspect, looped guide bars may be arranged horizontally and attached to an outer shade material at regular vertical intervals, with the inner lift sheet material threaded through the loop formed by the guide bars. The inner material or "roller shade" slides freely through the guide bars as the shade is rolled up without the use of a cord to "pull" up the shade. In this manner, the covering system provides a cordless lift mechanism that does not present the risk of child strangulation prevalent in shades that use corded lift mechanisms. The inner lift sheet material can be attached at or near the bottom of the lift sheet material at or near the bottom of the shade material, or can have some engaging elements such as magnetic strips, Velcro® fastener tapes, or an elongated bar sewn into the bottom of the inner lift sheet material that is of a greater length than the inner lift sheet material and of a greater length than the space between the two loops of the guide members that are positioned at spaced intervals along the vertical extent of the shade, such that the bar collects each guide member from the bottom up as the inner guide shade is raised to raise the outer shade material in the same stacked accordion fashion.

In implementations in which magnetic strips are employed as engaging elements, the magnetic strips are preferably weight sensitive to weight levels of around 8 pounds, or more or less, such that if a child were able to separate the inner lift sheet material from the guides, leaving the inner lift sheet material nonetheless attached to the shade material and crawling between them, the weight of the child would break the magnetic bond, opening the inner and outer materials to release the child from any otherwise hazardous confinement. Likewise, Velcro® fastener tapes can be used that are weight sensitive in character, so that respective tape members disengage from one another when the engaged strips are subjected to a separational weight thereon, e.g., of 8 pounds or less, or alternatively of 8 pounds or more.

In one embodiment, the invention relates to a cordless shade lift system is disclosed that can include a roller in one of a number of functional styles, including a conventional clutch mechanism with a loop pull cord that could be tied out of reach of small children or that can be encased within a loop cord enclosure, a spring loaded roller that enables manual raising or lowering, a gravity free rolling mechanism for easy specific positioning at any desired level, or a motorized mechanism for automatic raising or lowering.

In the motorized shade systems, an additional torsion based safety mechanism or safety clutch commonly known in the art can be arranged such that when the motorized system recognizes strain exceeding a predetermined value on the system, the motorized system will shut down and not raise the shade. Thus, the shade is not drawn up if for example a child manages to crawl into any potential pocket created at or near the bottom of the first lift sheet material as attached to the second shade material. Such a system can be combined with the bar, magnetic connector, or Velcro® hook and loop fastener system described above to further insure that a child would not get drawn up into the shade should they be able to insert themselves into a pocket created between the first lift sheet material and the second shade material.

In one embodiment, a cordless shade lift system inner material or "roller shade," is disclosed which may include a mesh or similar extension attached to the bottom end that incorporates a weighted dowel to "square" the shade. The material would ideally not be so thin and of such short width to allow the material to be bunched up creating a dangerous loop.

In one embodiment, guide members or continuous loops may be attached to a shade material to make a continuous loop around the inner lift sheet material of the lift system, such that the inner material is pulled up through the guide members thereby successively stacking (upwardly in a bottom up progression) the guide members as the inner lift sheet material is pulled upwardly through the guide members.

In another embodiment, guide members or hooks are disclosed that only extend around the inner lift sheet material to a relatively short extent, e.g., by about a couple inches, but which are continuous across the shade material behind the inner lift sheet material, effectuating a same stacking of the shade as the inner lift sheet material is drawn up by the roller. These guide members would not create a complete loop as described above, but would instead allow for the lift sheet material to be pulled through the hooks on each of the (left and right) sides of the shade assembly, rather than being pulled all the way through the continuous loop guides. This system combined with an elongated guide bar attached to the lift sheet at or need the bottom would allow for an additional safety element such that the inner lift sheet could be pulled away from the decorative material to keep small children from getting stuck in any pockets created therein should they crawl between the lift sheet and decorative material.

In another embodiment, a covering for an architectural opening is disclosed which comprises: a support member; a roller secured to the support member; a first material having a proximal portion secured to the roller, whereby the first material can be wound about the roller or unwound there from; a second material having a proximal portion secured to the support member and a distal portion secured to a distal portion of the first material; and at least one guide member attached to the second material, whereby the at least one guide member guides the second material about the first material as the first material is wound about the roller or unwound there from.

In one embodiment, a shade kit is disclosed that can be readily assembled with ease, that comprises: a support member; a roller secured to the support member; a first (inner guide) material having a proximal portion secured to the roller, whereby the first material can be wound about the roller or unwound there from; a second (shade) material having a proximal portion secured to the support member and a distal portion secured to a distal portion of the first material; and at least one guide member attached to the second material, whereby the at least one guide member guides the second material about the first material as the first material is wound about the roller or unwound there from. The at least one guide member can in specific implementations comprise at least one straight rod adapted to be fitted on each end to U-shaped guide members spaced apart to sufficiently couple each end of the first material for alignment of the first material as it is drawn up by the roller. Alternatively, the at least one guide member could comprise two straight rods adapted to be fitted on each end with U-shaped guide members so as to form a complete loop around the first material.

In another embodiment, a system with a do-it-yourself kit is disclosed that comprises a support member; a roller secured to the support member; a first lift sheet (inner guide) material having a proximal portion secured to the roller, whereby the first material can be wound about the roller or unwound there from; a second (decorative shade) material having a proximal portion engaged with the support member and a distal portion secured to a distal portion of the first material, wherein the decorative shade is devoid of a liner, the need for which is obviated by the first lift sheet material; and at least one guide member attached to the second material, whereby the at least one guide member guides the second material about the first material as the first material is wound about the roller or unwound there from. The system may include U-shaped rings that easily fit on guide bars to create the guide members. The guide bars may have loops or holes in one or more places for sewing to the decorative shade, or may be attached within a pocket created by or on the back of the decorative shade and/or with a Ronco® button fastener or rivets allowing for easy attachment. The decorative shade itself can be readily clamped, fastened or attached at one end to the support member and engaged at a different section to the lift sheet material.

In one embodiment, a covering as described above is disclosed, wherein the at least one guide member comprises a plurality of guide members attached at intervals along the second material, that fold the second material into an accordion folded compacted form when the first material is wound about the roller.

In another embodiment, a cordless cover system for an architectural opening is disclosed, comprising: a support member; a rolling mechanism secured to the support member; a first material having a proximal portion secured to the rolling mechanism, whereby the first material can be wound about the roller or unwound there from; a second material having a proximal portion secured to the support member and a distal portion secured to a distal portion of the first material; and at least one guide member attached to the second material, whereby the at least one guide member guides the second material about the first material as the first material is wound about the rolling mechanism or unwound there from.

In a further embodiment, a method of making a cordless cover for an architectural opening is disclosed, comprising: providing a support member; attaching a rolling mechanism to the support member; attaching a first material at a proximal location of said first material to the rolling mechanism, whereby the first material can be wound about the roller or unwound there from; attaching a second material at a proximal location of said second material to the support member; attaching a distal location of said second material to a distal location of said first material; and attaching at least one guide member to the second material, whereby the at least one guide member guides the second material about the first material as the first material is wound about the rolling mechanism or unwound there from.

Also disclosed is a cordless covering system, comprising a covering sheet suspended or suspendable from a support and secured at its lower end portion to a lower end portion of a lifting sheet that is joined at its upper end to a lifting and lowering apparatus, with guide structure that couples the covering sheet with the lifting sheet so as to enable the lifting sheet during lifting thereof to compact the covering sheet into an upwardly compacted form, and during lowering thereof to release the covering sheet from its upwardly compacted form to a downwardly extending sheet conformation.

In one aspect of such cordless covering system, the guide structure comprises laterally extending guide members coupled to the covering sheet and engaging the lifting sheet at edge portions thereof.

In another aspect, the lifting sheet has secured to a distal end thereof a laterally extending bar that engages the guide structure to effect folding of the covering sheet into an accordion-folded compacted form when said lifting sheet is lifted.

In another embodiment, a cordless covering system is disclosed, wherein the covering sheet and lifting sheet are secured to one another at their distal portions by matably engageable securement elements on each of said distal portions.

The cordless covering system in a further aspect comprises a monitoring assembly adapted to stop the lifting sheet from being lifted when stress, load or strain exceeding a predetermined value is sensed by the monitoring assembly as being exerted on a location or component of the cordless shade system.

In another aspect, the cordless covering system comprises a motor arranged to reversibly raise or lower the lifting sheet.

In another aspect, a loop cord control enclosure is disclosed to encase a looped cord attached to the shade or blind system at the top to drive the rolling mechanism that raises and lowers a shade or blinds. The cord is encassed to protect any hazardous loops from being exposed, and exposes the cord on each side of a shaft to allow an operator to draw the cord and shade/blind up and down. The mechanism is adapted to be retrofitted onto an existing shade or originally fit on any of the systems described above. In one embodiment, the loop cord enclosure is attached at the roller at the top, has the cord encased in an enclosure with two channels (also called "cord tracks") to keep each loop separate, has the cord exposed in the middle on each side of a shaft, and is again enclosed at the bottom all the way to a pully wheel. In another embodiment, that pully wheel at the bottom may alternatively be a spring tension mechanism or a weight to keep the cord taut.

In another aspect, a cord channel enclosure may completely enclose the cord and utilize a slider to actuate the cord within the cord channel enclosure.

Other aspects, features and embodiments will be more fully apparent from the ensuing disclosure and appended claims.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the disclosure, and together with the description serve to explain the principles of the disclosure.

Figure 11:
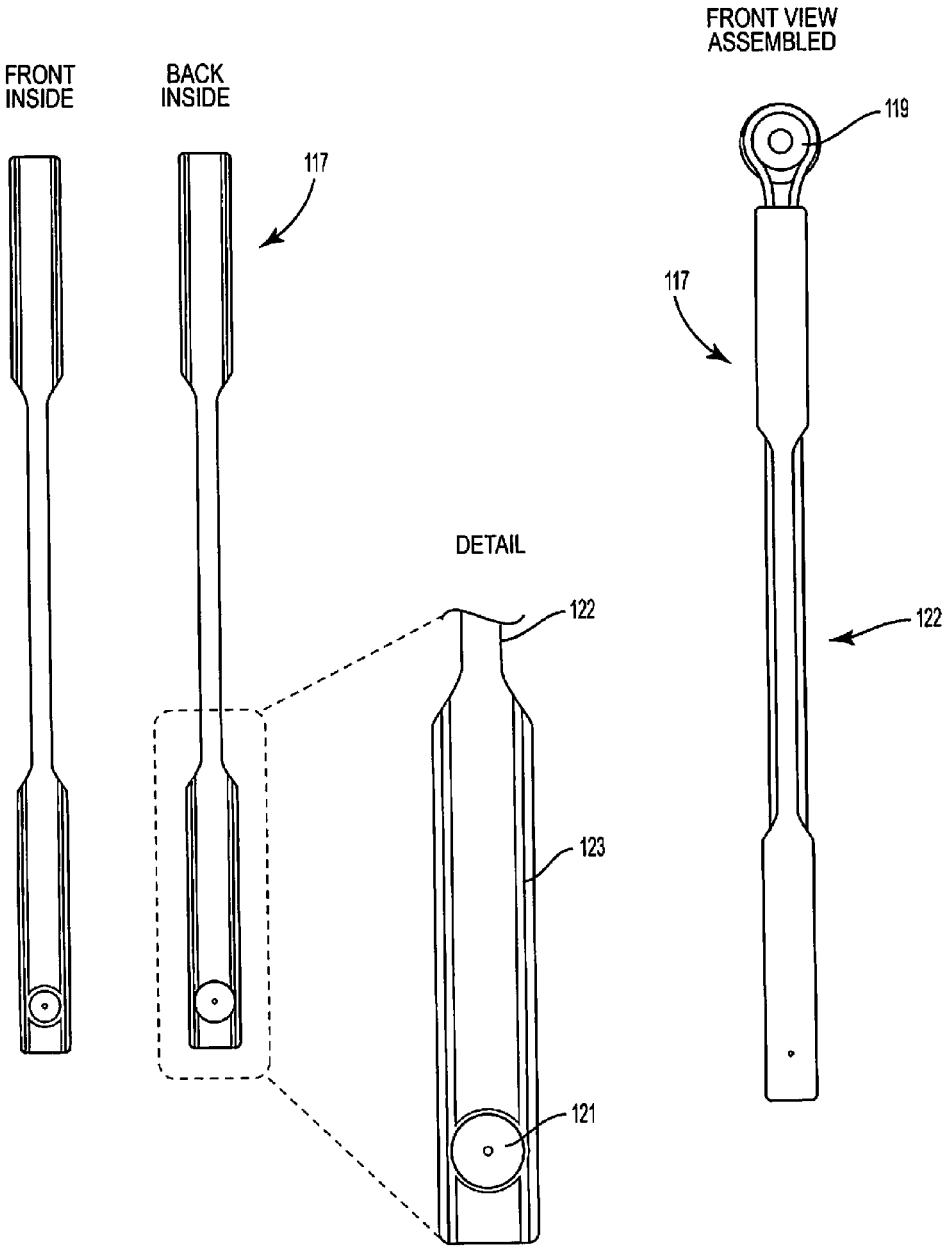

FIG. 11 a schematic representation of one embodiment comprising a cross-sectional front inside and back inside view of the sheathed dual channel pull cord enclosure, a front-view assembled view, and a detailed cross sectional view.

Figure 12:
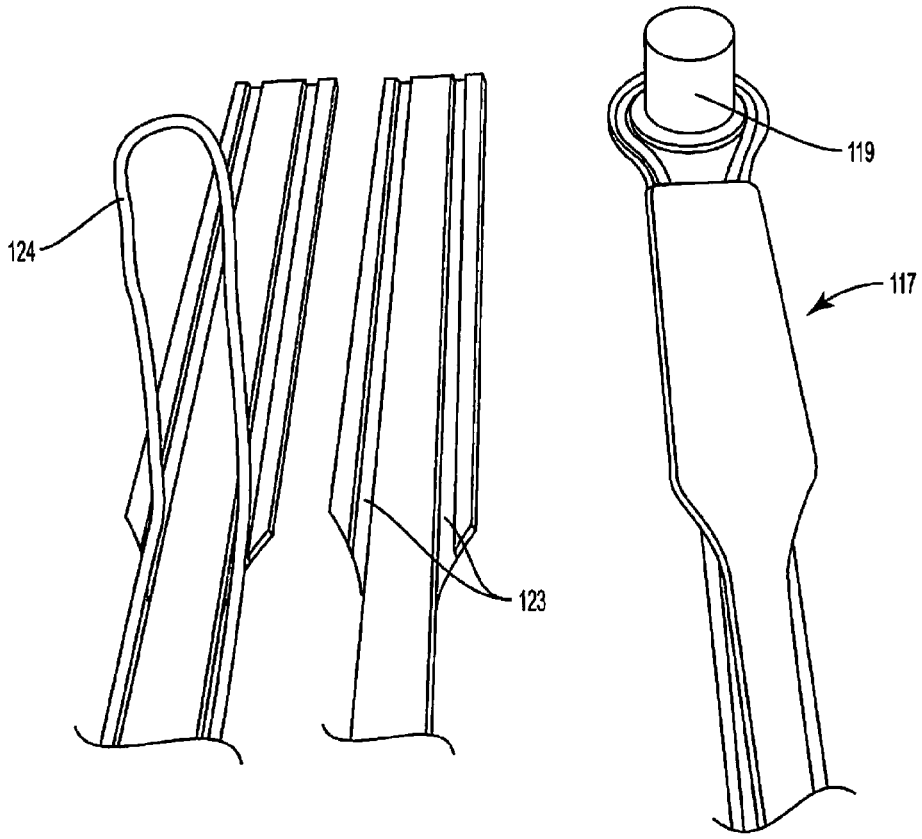

FIG. 12 is a close-up representative view of one embodiment of the top of a sheathed dual channel pull cord enclosure with a cross-sectional view of each side on the left and an assembled view on the right.

Figure 13:
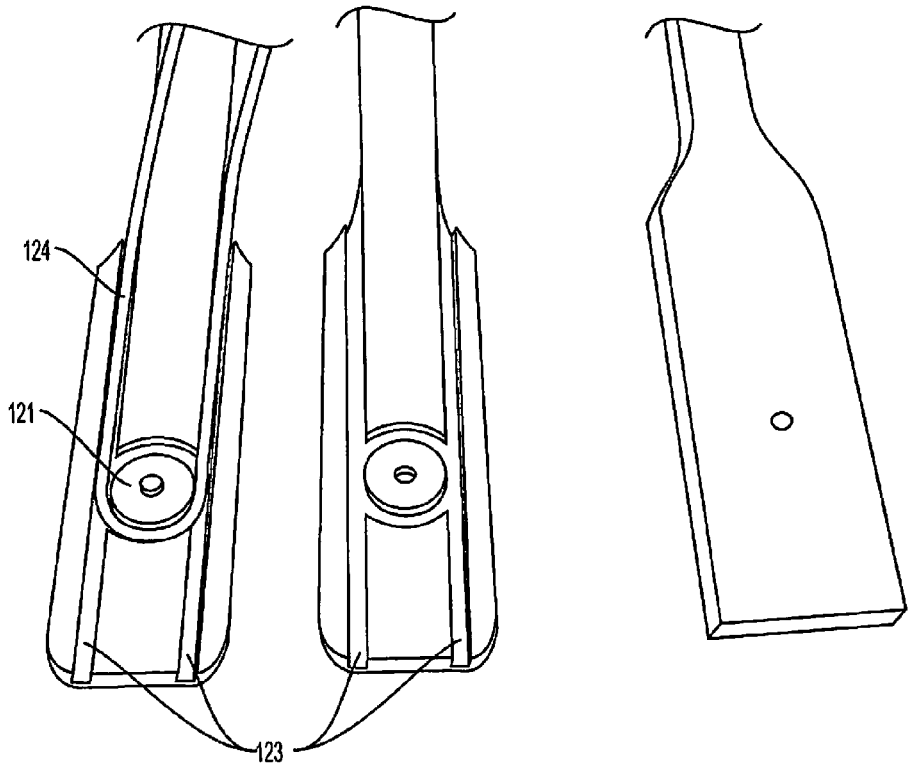

FIG. 13 is a close-up representative view of one embodiment of the bottom of a sheathed dual channel pull cord enclosure with a cross-sectional view of each side on the left and an assembled view on the right.

Figure 14:
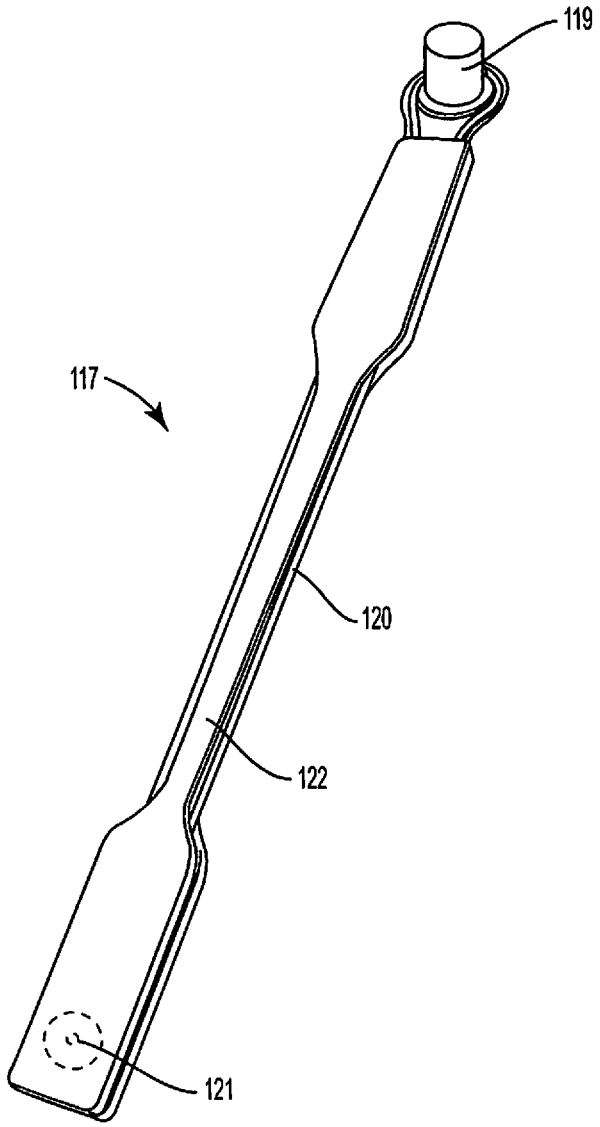

FIG. 14 is a representative view of one embodiment of the sheathed dual channel pull cord enclosure.

Figure 15:
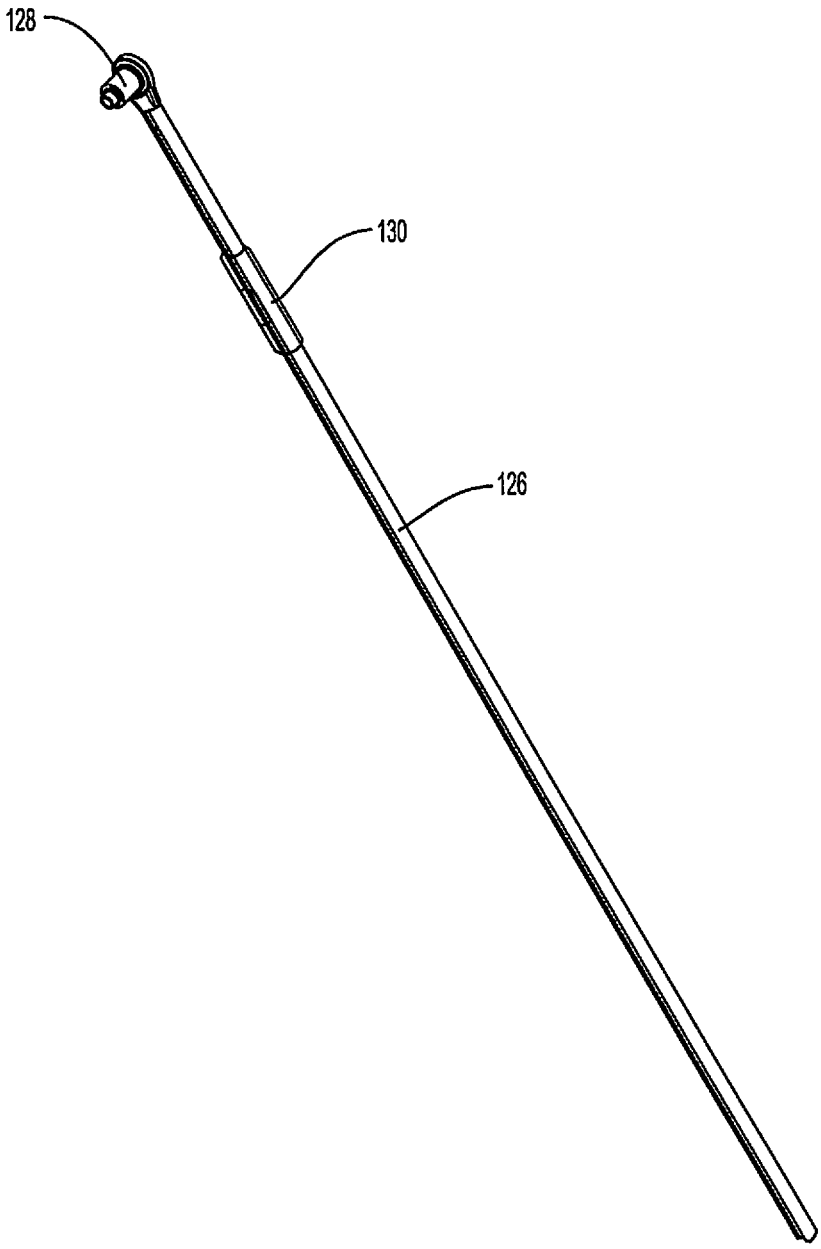

FIG. 15 is a perspective view of a second embodiment of a cord channel enclosure.

Figure 16:
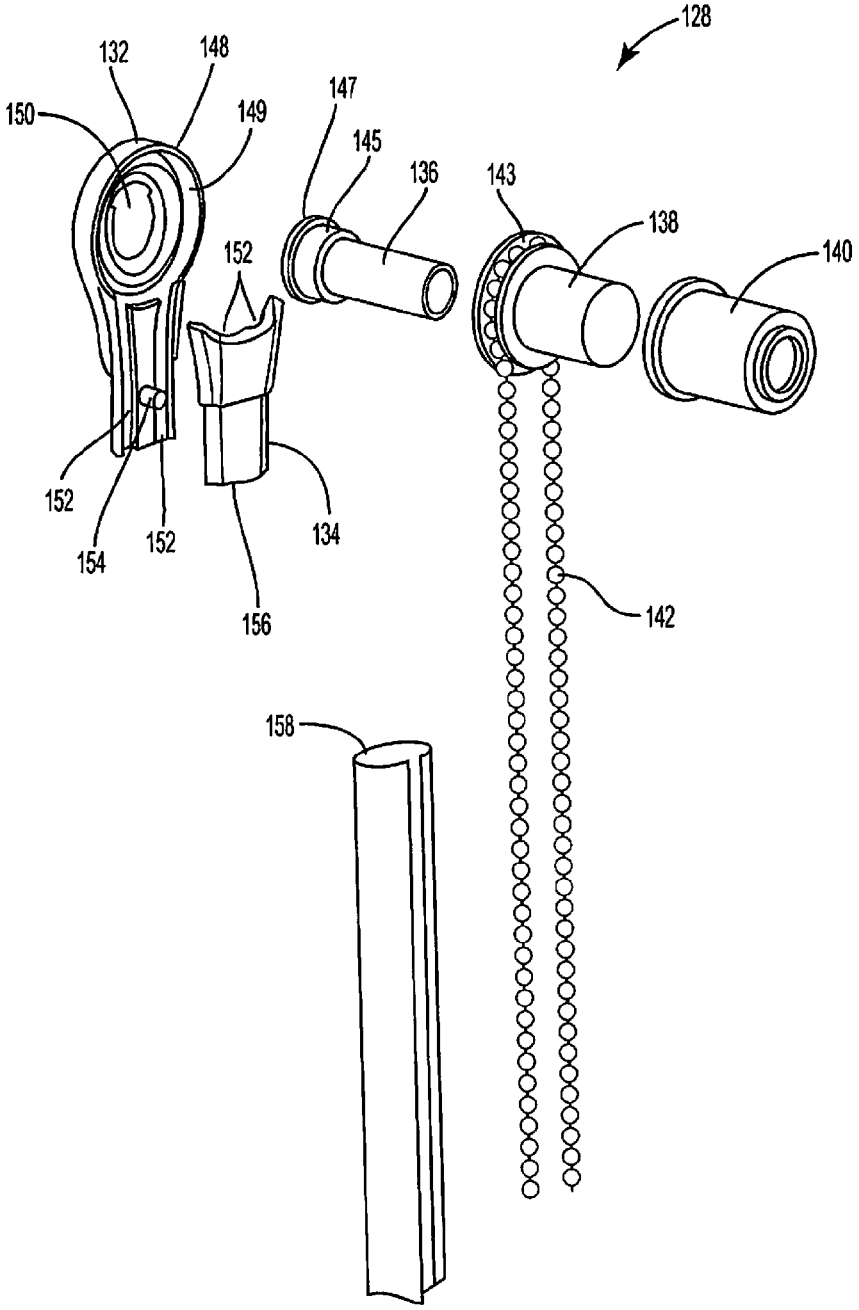

FIG. 16 is an exploded view of a roller mechanism in the second embodiment of the cord channel enclosure.

Figure 17:
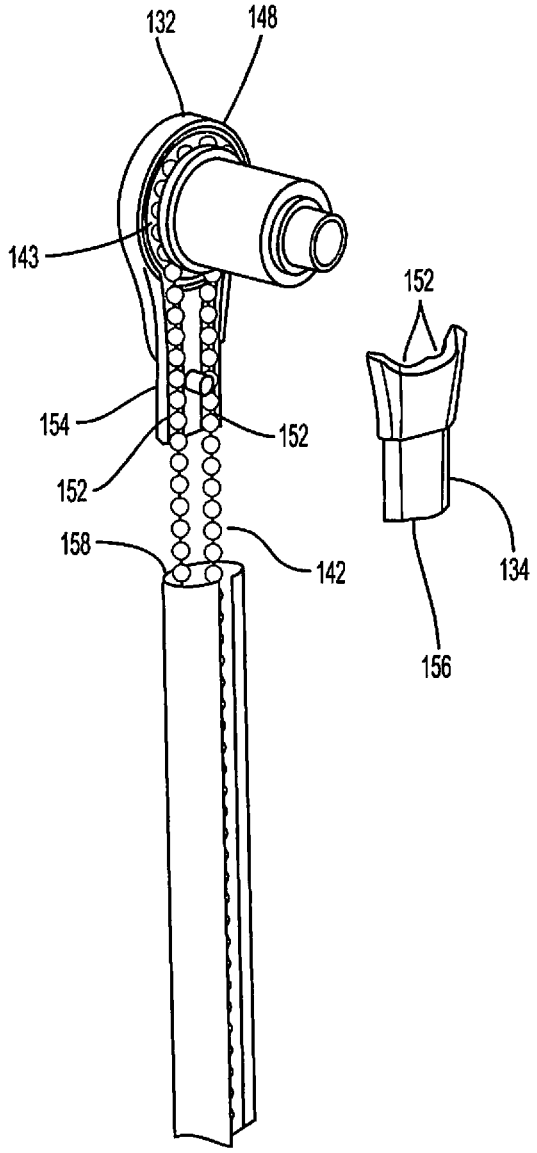

FIG. 17 is a perspective view of the roller mechanism having a cord placed within an engagement chamber.

Figure 18:
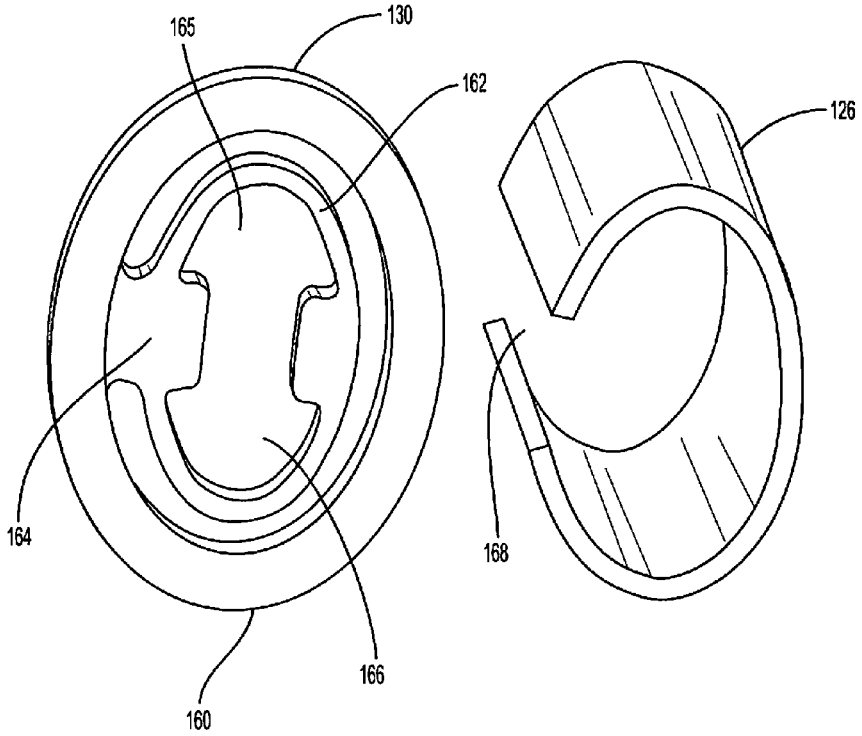

FIG. 18 is a separated view of a slider and the second embodiment of the cord channel enclosure.

Figure 19:
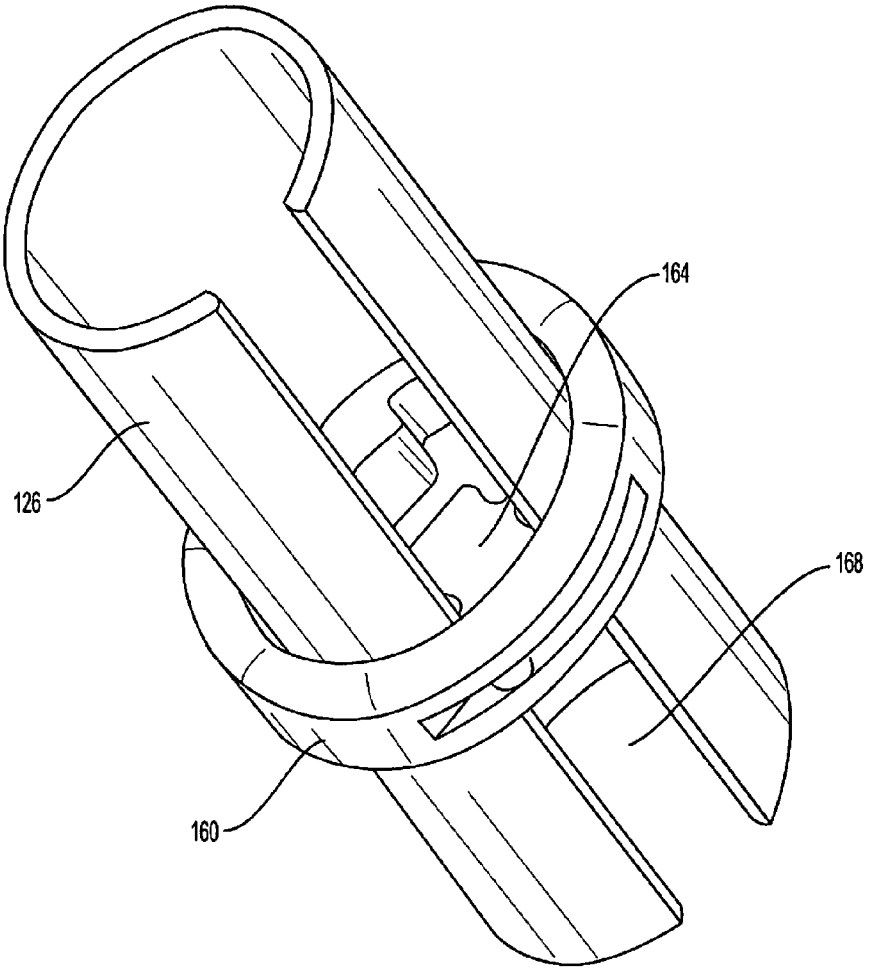

FIG. 19 is a perspective view of the slider engaged with the second embodiment of the cord channel enclosure.

Figure 20:
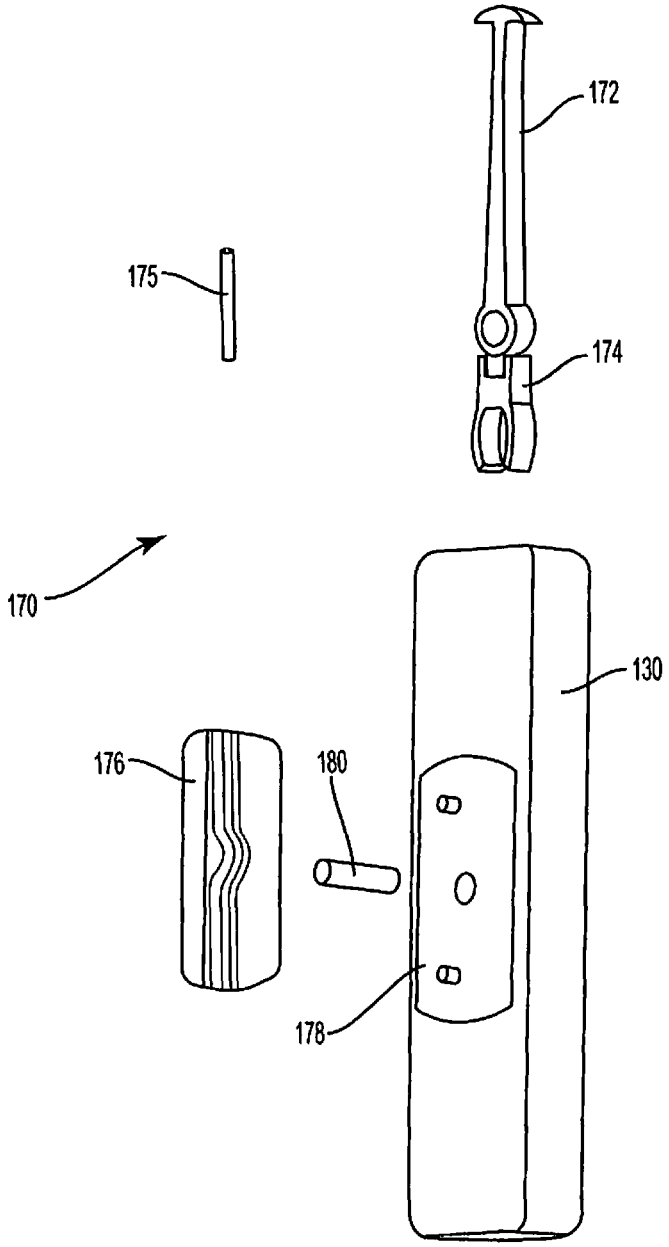

FIG. 20 is an exploded view of the slider and a cord engagement mechanism.

Figure 21:
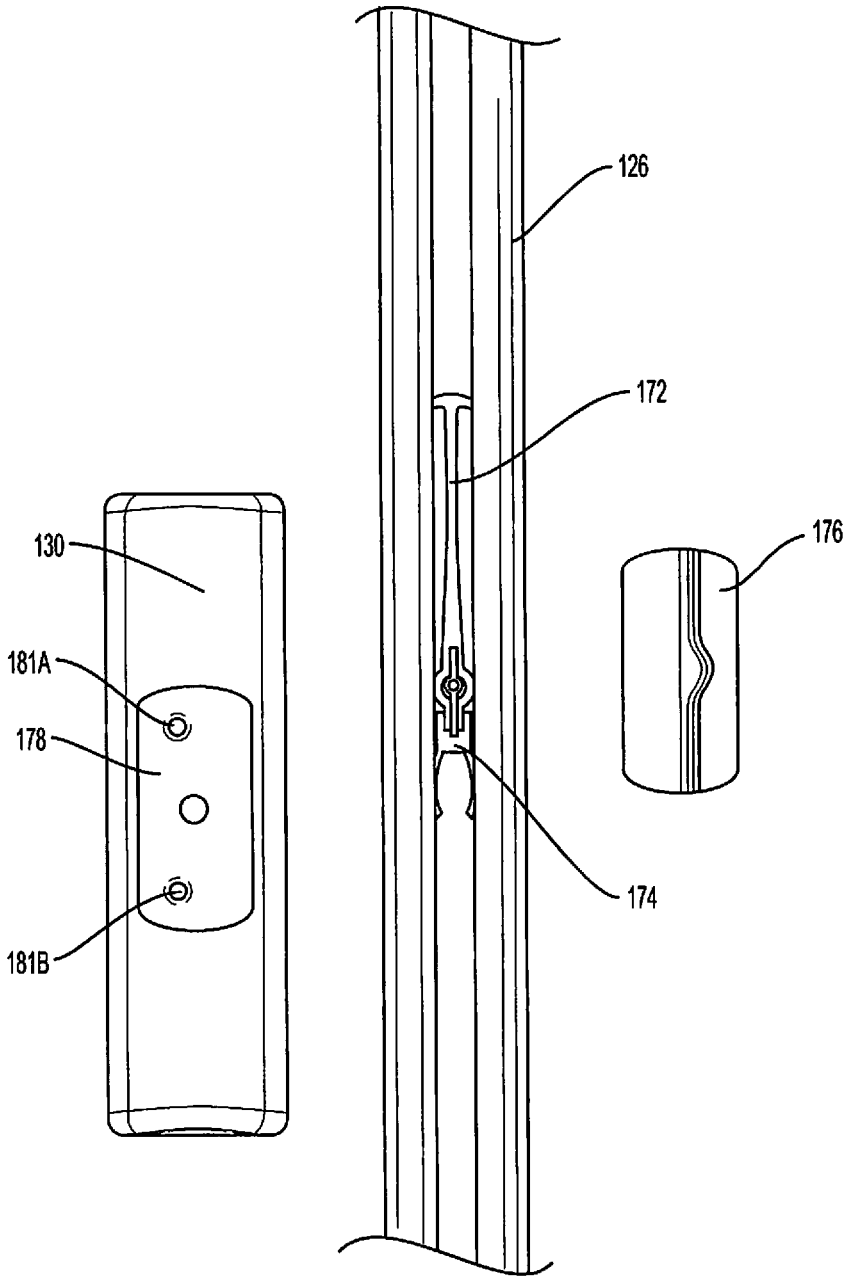

FIG. 21 is a separated view showing a cord engagement member and a cord disengagement member within the second embodiment of the cord channel enclosure, an actuation component, and the slider.

Figure 22:
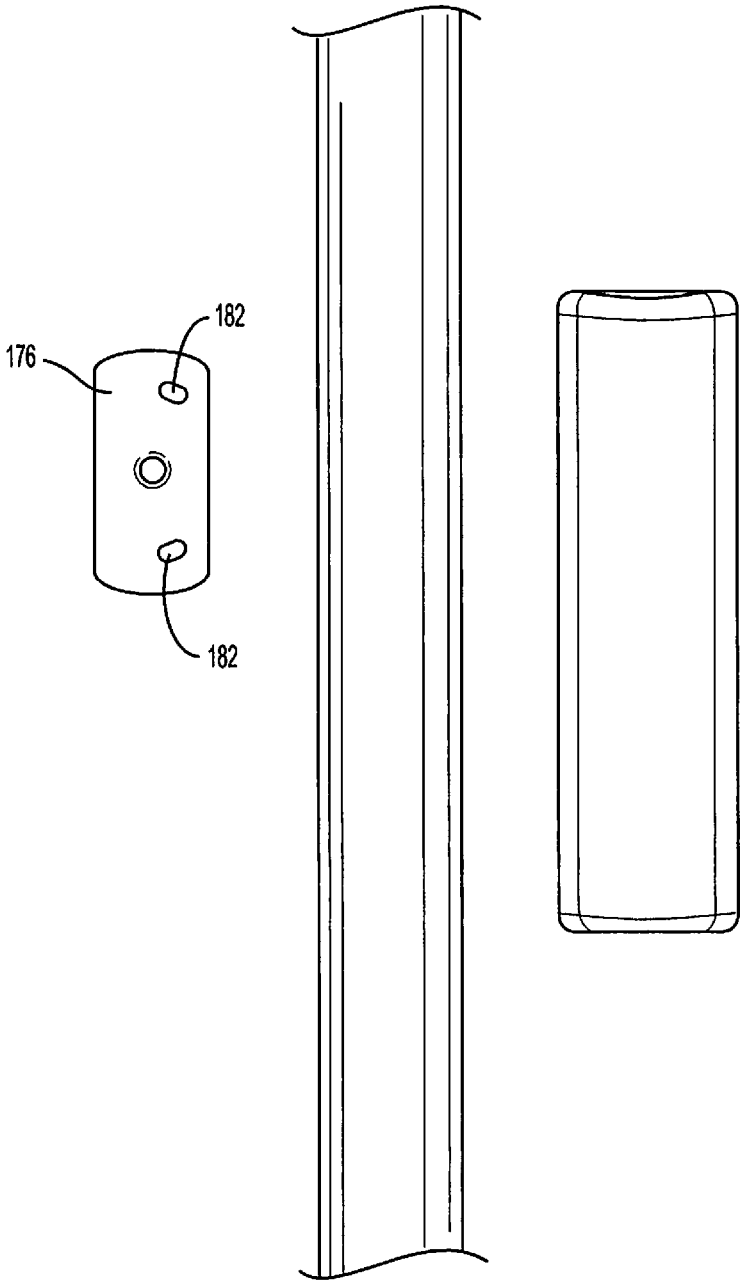

FIG. 22 is another separated view showing the second embodiment of the cord channel enclosure, the actuation component, and the slider.

Figure 23:
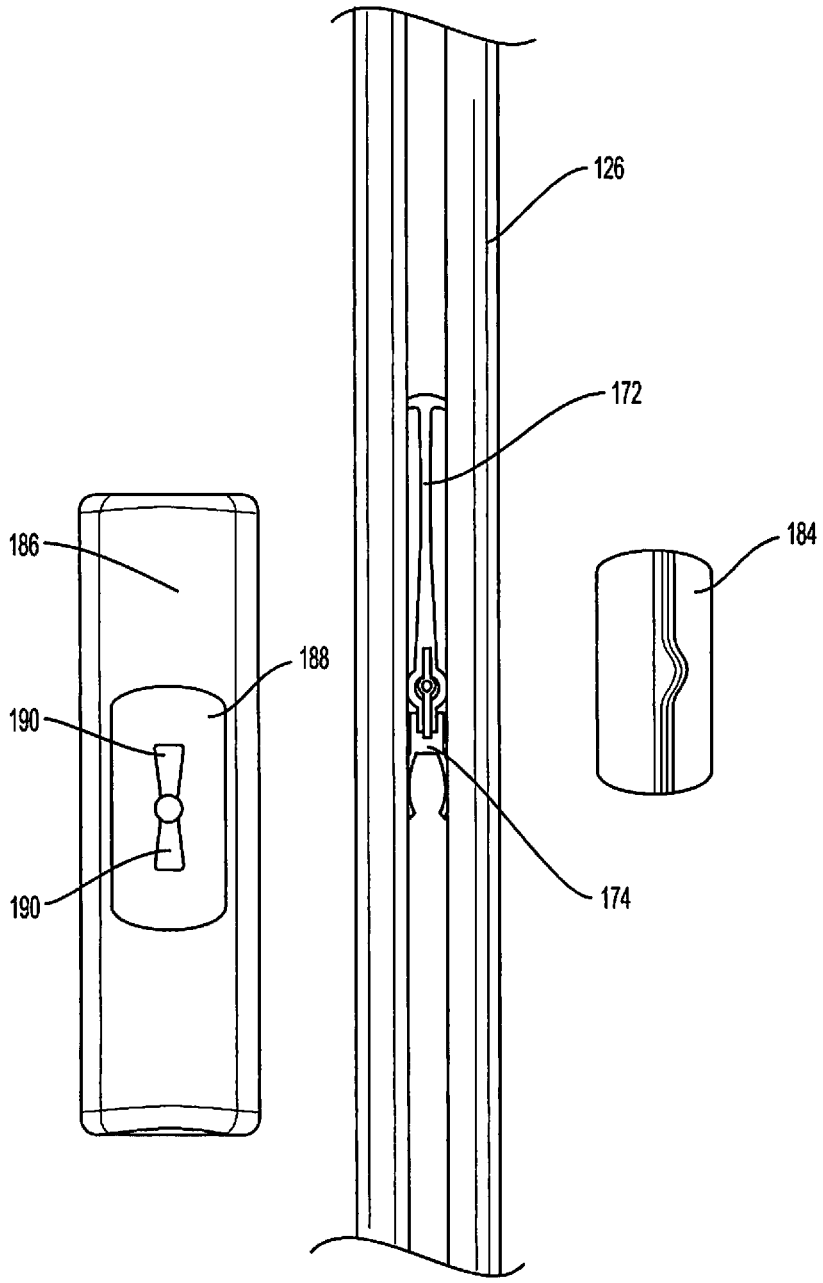

FIG. 23 is a separated view showing the cord engagement member and the cord disengagement member within the second embodiment of the cord channel enclosure, another embodiment of the actuation component, and another embodiment of the slider.

Figure 24:
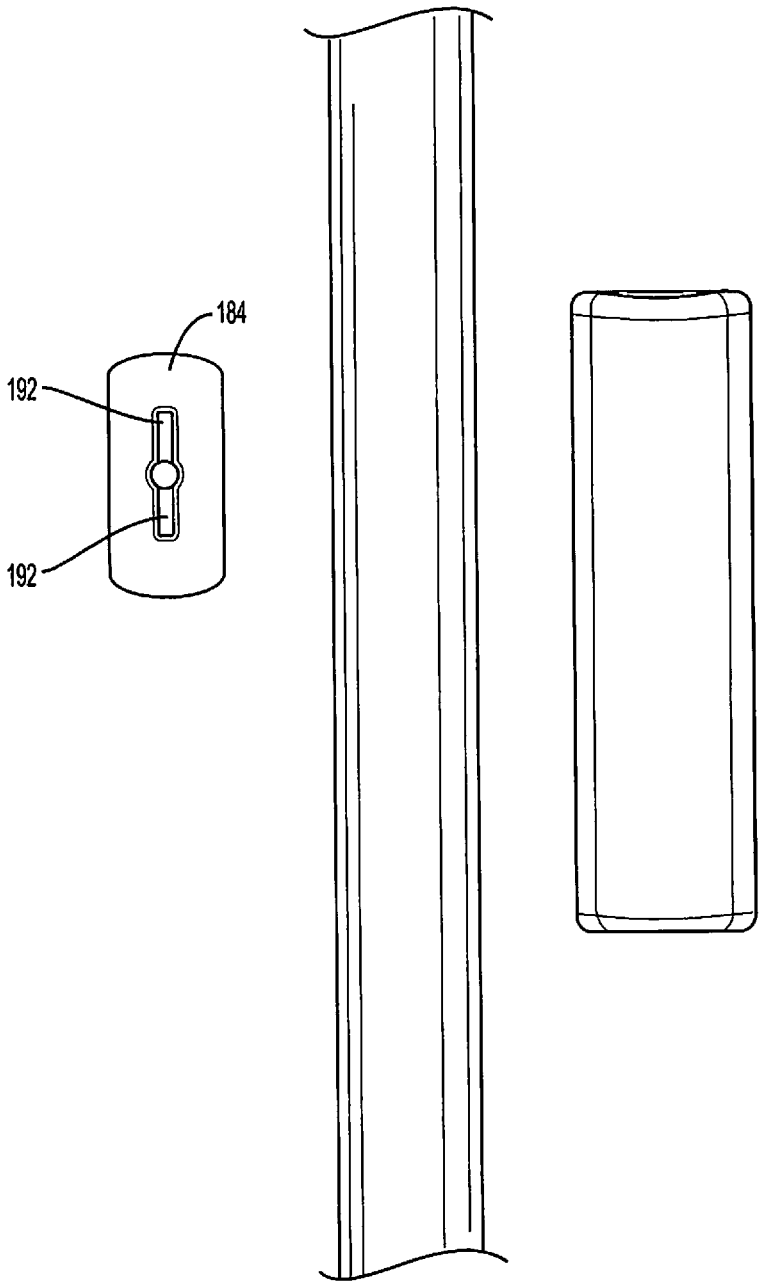

FIG. 24 is a separated view showing the second embodiment of the cord channel enclosure, the other embodiment of the actuation component, and the other embodiment of the slider.

Figure 25:
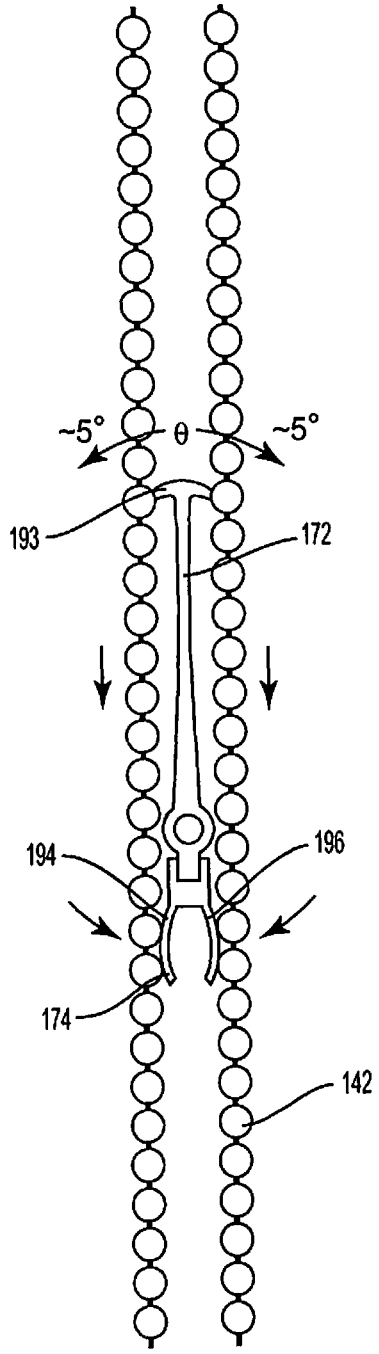

FIG. 25 is a side view of the cord engagement member, the cord disengagement member, and the cord.

Figure 26:
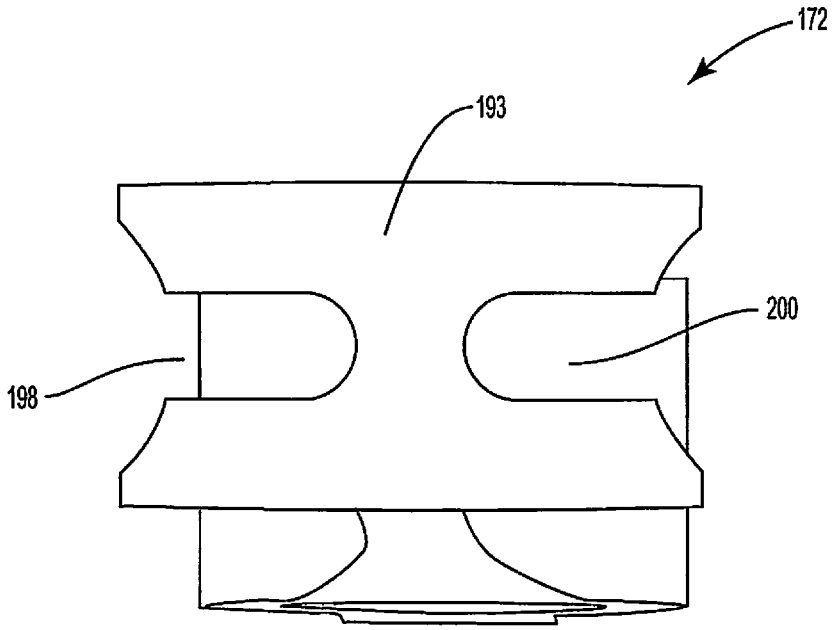

FIG. 26 is a top view of the cord engagement member.

Figure 27:
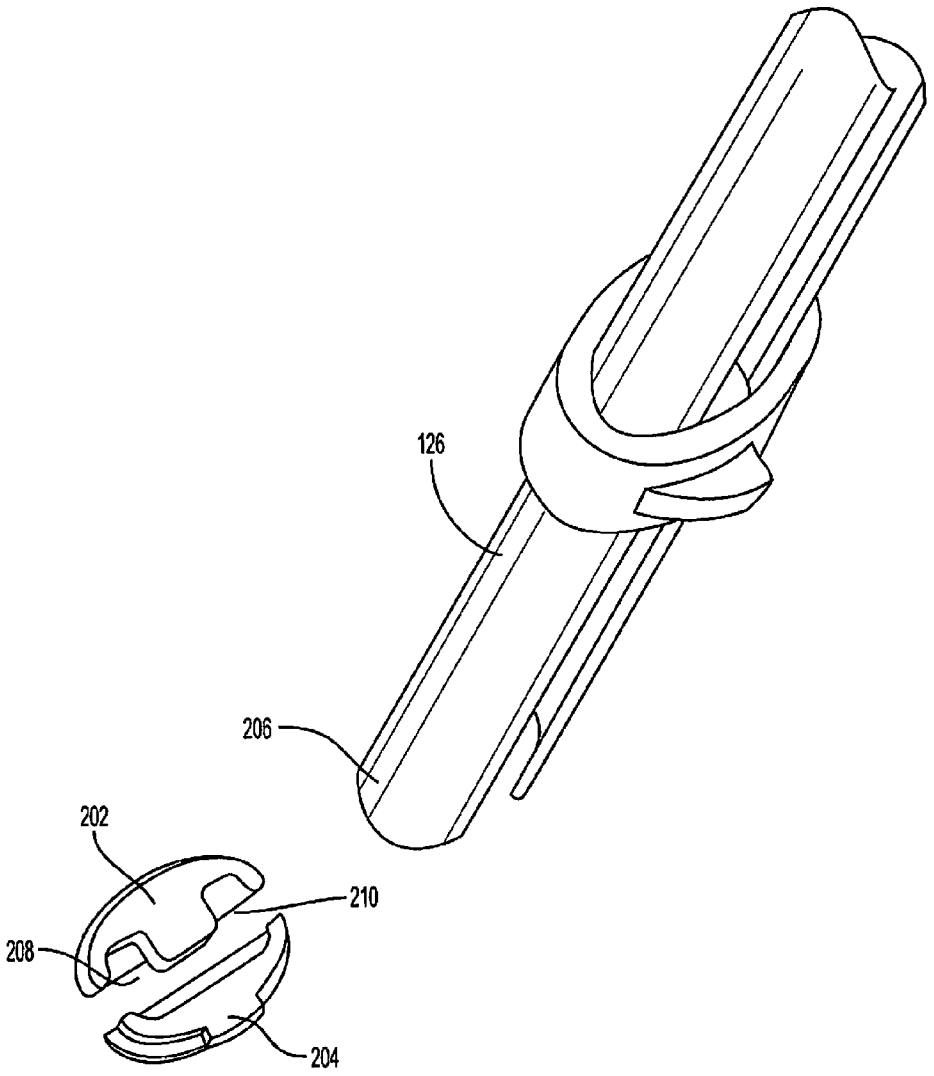

FIG. 27 is an exploded view of end structures for second embodiment of the cord channel enclosure.

Figure 28:
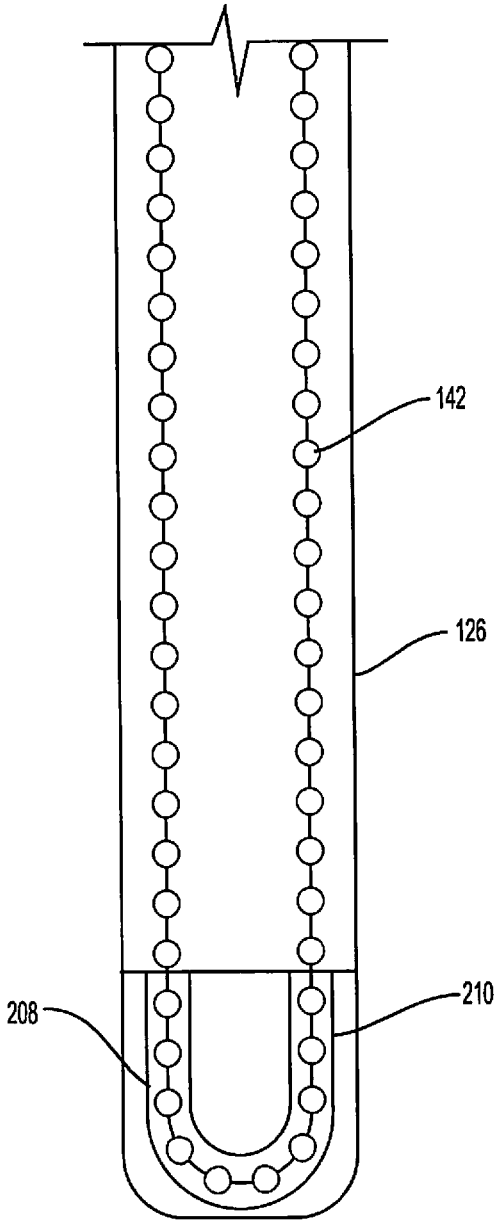

FIG. 28 is a cross sectional view of the bottom of the second embodiment of the cord channel enclosure.

DETAILED DESCRIPTION

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

Embodiments disclosed in the present Specification relate to a cordless covering for an architectural opening, such as a window, door or the like.

The advantages and features of the embodiments disclosed herein are further illustrated with reference to the following disclosure, which is not to be construed as in any way limiting the scope of the invention but rather as illustrative of the invention in a specific application thereof.

Figure 1:
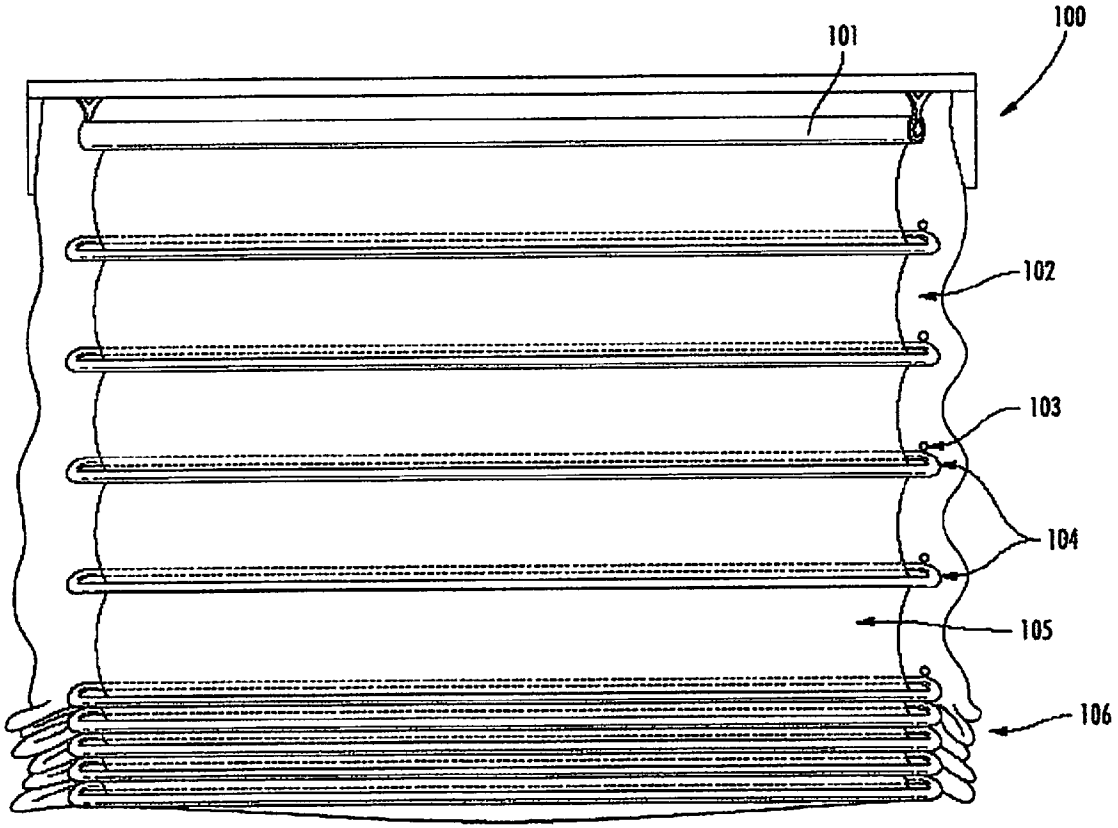
FIG. 1 is a representative back view of one embodiment of the cordless covering system.

In one embodiment, the cordless covering system is schematically depicted in FIG. 1 from the back side, showing the first lift sheet material with the decorative shade material behind it. The cordless shade system includes a support member 100 for attaching to or above a window, door, portal or other architectural opening. The support member 100 is preferably attached at the top of the architectural opening so that gravity can aid in lowering the covering or shade 102 over the opening. The decorative shade (second) material 102 is preferably attached to the support member 100 at one end, and is affixed or engaged in some way to a flexible inner guide (first) lift sheet material 105 at another end. The inner lift sheet material 105 replaces cords in a corded system, whereby the potential danger of strangulation for small children is avoided. The inner lift sheet material 105 is typically affixed or engaged near or at its bottom with the decorative shade material 102, at or near the bottom of the shade material 102. This arrangement allows the shade material 102 to be fully extended when the inner lift sheet material 105 is fully extended. The decorative shade material 102 may be affixed or engaged to the decorative shade material 102 in any suitable manner, such as with magnetic strips, Velcro® hook and loop fastener members, adhesive, stitching, a pocket for collecting the bottom-most guide member 104, or by having a lift sheet material engagement bar 113 attached to the inner lift sheet material 105 via a stitching or lift sheet material engagement bar pocket 114 that is of greater length than the width defined by the guide members 104 secured to the decorative shade material 102.

The flexible lift sheet material 105 can be any woven or non-woven material, fabric or the like that is strong enough to raise the decorative shade material 102 from the end thereof opposite the end that is attached to the support member 100. Ideally, the decorative shade material 102 will have one or more guide members 104 that allow the flexible inner lift sheet material 105 to pass through as it is raised or lowered by a roller 101. The decorative shade material 102 is attached, e.g., sewn, bonded or otherwise removably or non-removably secured to the guide members at one or more attachment points 103.

In the illustrated embodiment, the attachment point 103 is a simple circular eyelet at each end of the guide member 104. As the roller 101 begins rotating in a direction that draws in the lift sheet material 105, the lift sheet material 105 attached at the bottom to the shade 102 begins pulling on the shade until the very bottom guide member 104 starts being raised. The lift sheet material 105 passes through the guide member 104, drawing up the bottom guide member 104 and shade 102 that are attached to one another at attachment point 103 until the bottom guide member 104 reaches the next highest guide member 104 from the bottom. This process continues as the guide members 104 are drawn together like an accordion to form a compacted folded conformation 106 as shown in FIG. 1, wherein the shade 102 is folded up. At a final point, the all guide members 104 will be collected together. At this point the flexible member 105 is fully raised by the roller 101. Variable length guide members, support members, shade material, and lift sheet material may be provided as components of a do-it-yourself kit for the cordless shade system.

Figure 5:
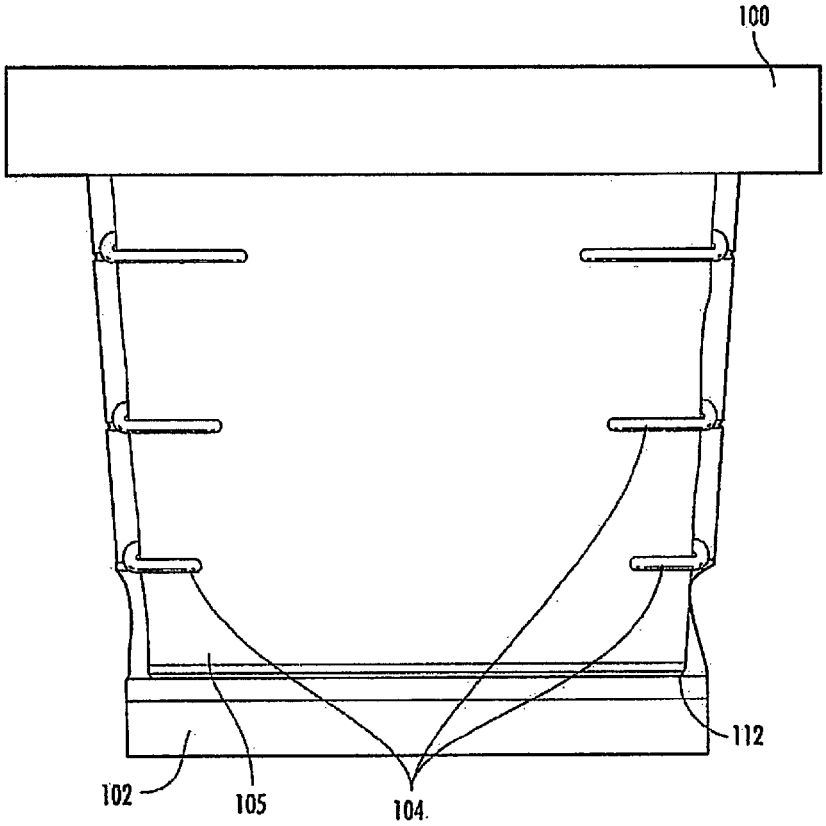
FIG. 5 is a representative view of the back of one embodiment of the cordless shade system.
Figure 7:
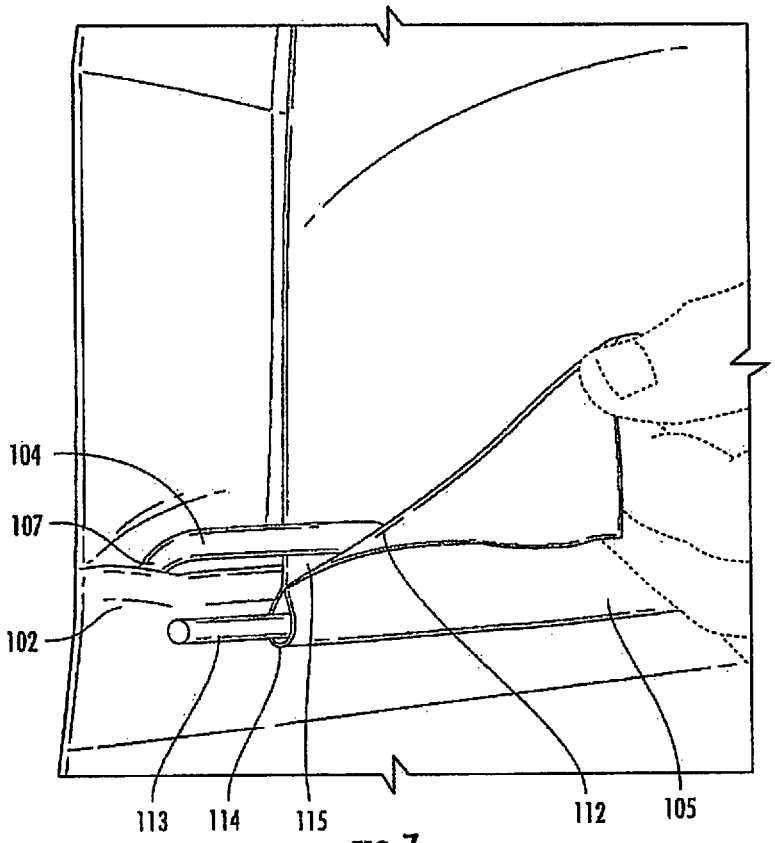
FIG. 7 is a representative view of the shade engaged with the lift sheet material in one embodiment.
Figure 8:
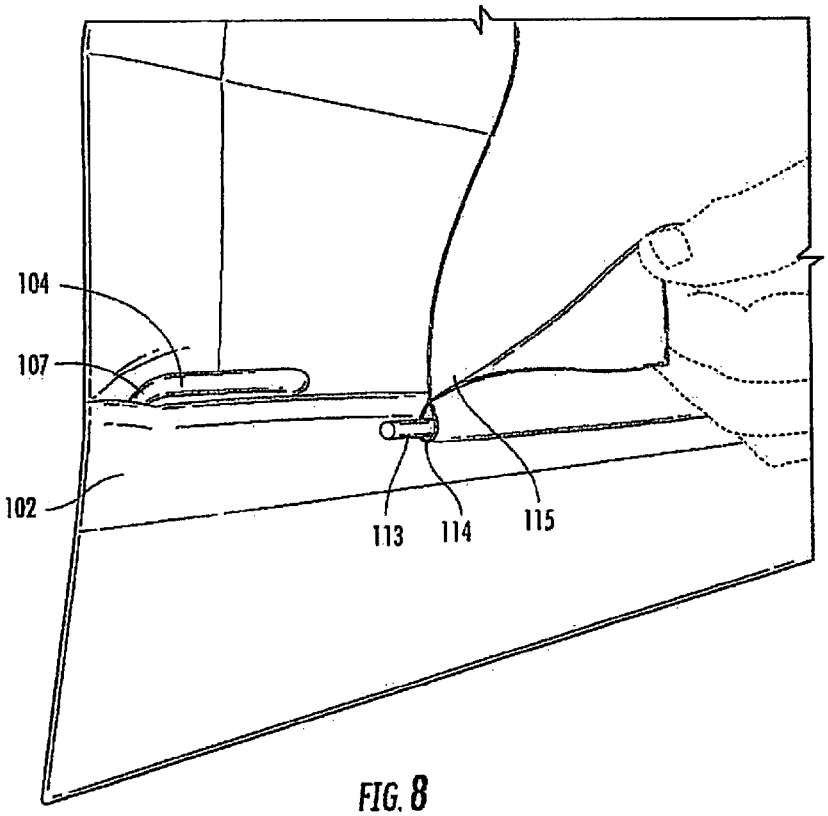
FIG. 8 is a representative view of the shade disengaged with the lift sheet material in one embodiment.

The guide members 104 are advantageously selected to be strong enough to handle the weight of the entire shade 102 along with any other guide members 104 drawn up by the lift sheet material 105, but light enough not to cause excessive strain on the roller 101. The guide members 104, including guide rods 108 and end clips or U-shaped brackets 107, can be made of any suitable metal, plastic, polymer, acrylic, or other material, and may be formed by extrusion, injection molding, machining, casting, forging, etc. One advantageous embodiment includes metal guide rods 108 and injection molded end clips or brackets 107. The guide members 104 can form an entire loop shape with two equal length bars 108 capped on each end with U-shaped ends 107 to constitute a complete loop around the lift sheet material 105. Such U-shaped end caps 107 might ideally have female connectors to allow coupling to male ends on the guide rods 108 for ease of installation. The guide members could also merely comprise one guide shaft 108 attached to the shade 102 with hook or U-shaped brackets 107 on each end of each guide shaft 108 to sufficiently couple the lift sheet material 105 as for example is shown in FIGS. 5, 7 and 8.

Likewise, the attachment points 103 are advantageously strong enough to attach the guide members 104 to the shade 102 in any number of ways, including attachment with sew holes, rivets, button fasteners or the like. Additionally, the guide shafts or rods 108 of the guide members may be rectangular in profile or cylindrical with a flat surface or 2 flat surfaces, e.g., with a profile of ⅜"×3/16" and having any suitable length. Alternatively, or in addition, the guide rods 108 can include small sew holes spaced along the length of the rod, to allow the decorative shade 102 to be sewn to or otherwise attached in a secure manner to the guide members 104.

Figure 2:
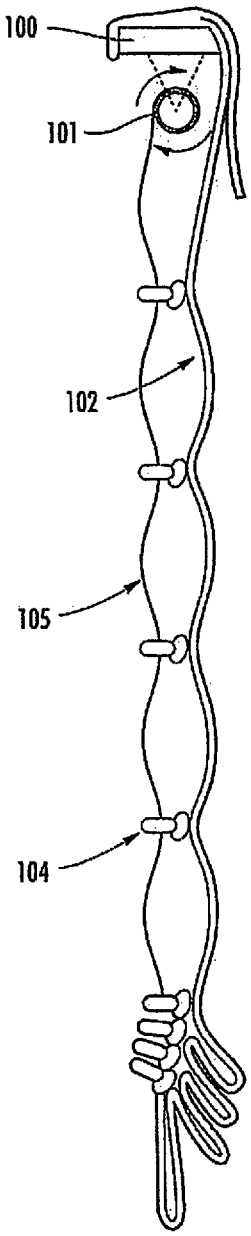
FIG. 2 is a representative side view of one embodiment of the cordless covering system.

FIG. 2 is a representative side view of one embodiment of the cordless covering system, again disclosing the support member 100, roller 101, shade 102, guide members 104, and lift sheet material 105. Note that this view depicts the shade 102 partially drawn up with a number of guide members 104.

Figure 3:
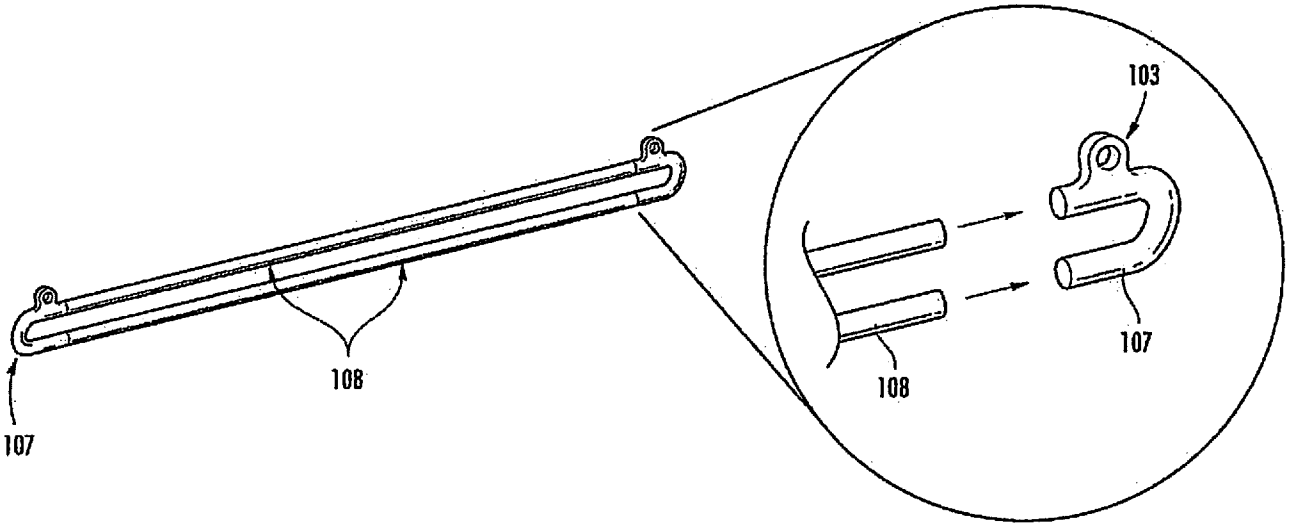
FIG. 3 is a representative view of the guide member with a blow-up view of the components in one embodiment of the cordless covering system.

FIG. 3 depicts the guide member 104 with U-shaped brackets 107 that can be adapted to any length of guide shaft 108, to accommodate any size of architectural opening. In addition, an exploded view of the guide bar 104 reveals an attachment point 103 as comprising an eyelet in one embodiment.

Figure 4:
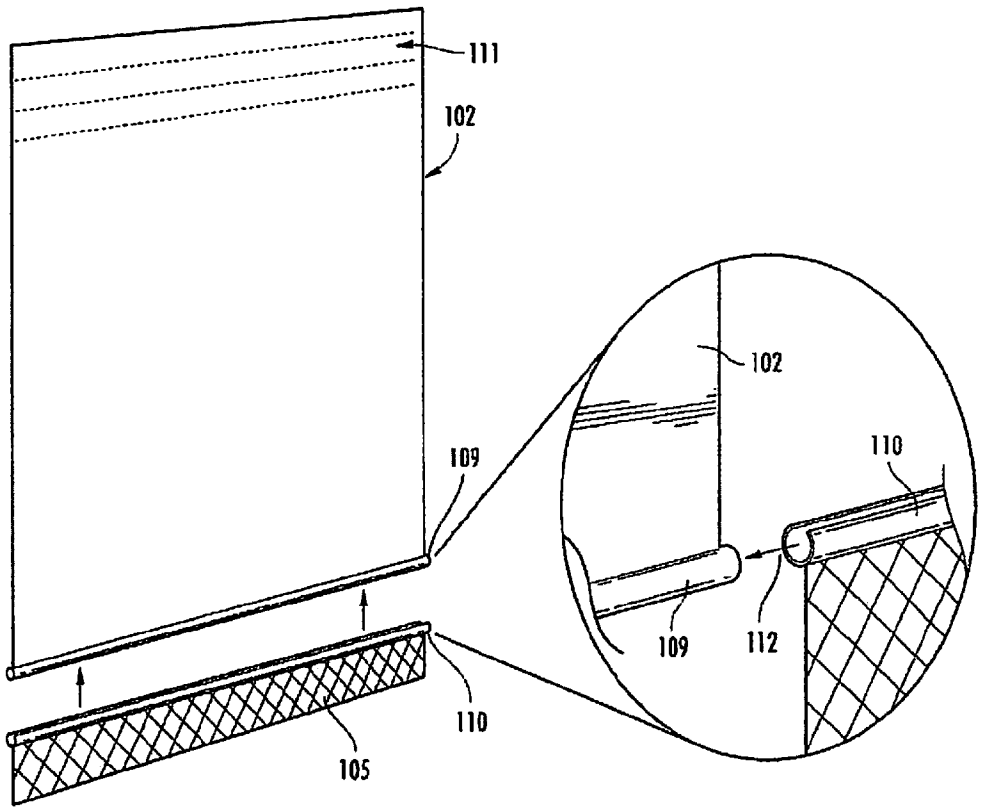
FIG. 4 is a schematic representation of one embodiment comprising the materials utilized in the method of making a cordless cover for an architectural opening, in accordance with one embodiment.

FIG. 4 is a schematic representation of one embodiment comprising the materials utilized in the method of making a cordless covering for an architectural opening, in accordance with one embodiment. In particular, FIG. 4 reveals the shade 102 with perforated cut lines 111 for sizing the shade 102 and attachment to the support member 100, a molded dowel rod 109 attached at the bottom of the shade 102, a lift sheet material 105 that has a slotted channel as one embodiment of a guide material engagement member 110, wherein the slotted channel 110 and molded dowel rod 109 are designed to fit together at an attachment point 112, to attach the shade 102 to the lift sheet material 105 as is shown in the exploded view in FIG. 4.

FIG. 5 is a schematic representation of the back of one embodiment of the cordless shade system, comprising the support member 100, shade 102, guide members 104, and lift sheet material 105.

Figure 6:
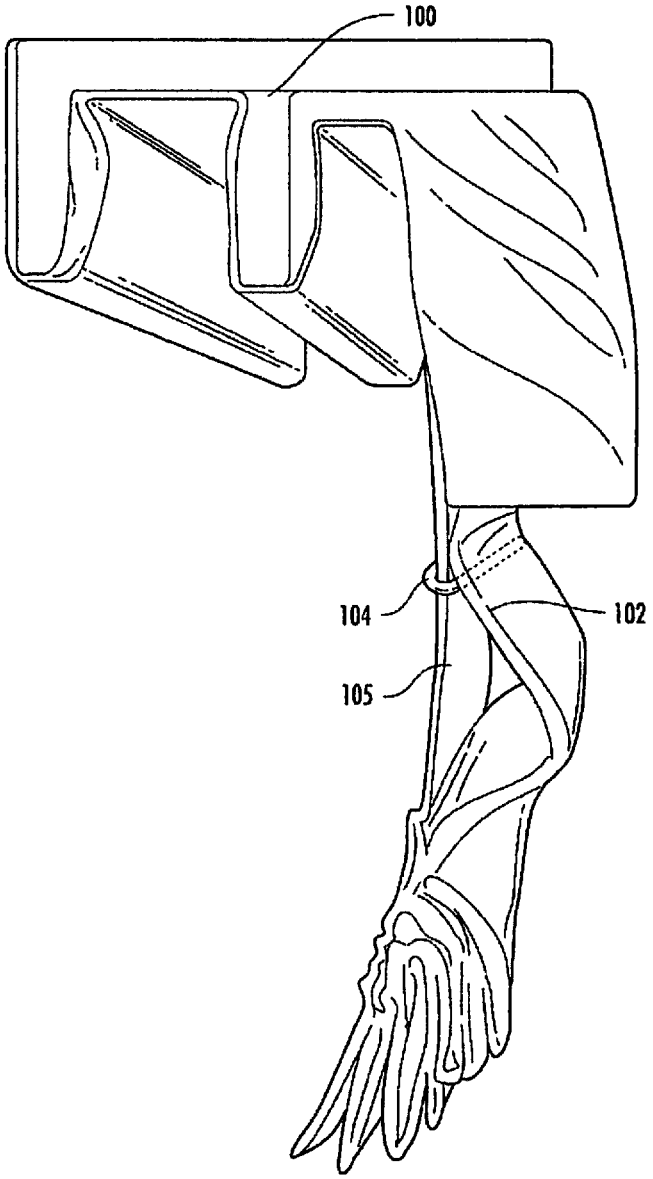
FIG. 6 is a representative view of the side of one embodiment of the cordless shade system.

FIG. 6 is a schematic representation from the side of one embodiment of the cordless shade system, comprising the support member 100, shade 102, and lift sheet material 105.

FIG. 7 is a schematic representation from the exploded back side of the shade member 102 as engaged with the lift sheet 105 by way of a guide member 104 that has a portion of the U-shaped end clip 107 secured by a pocket 115 created above the enclosure 114 near the bottom of guide material 105 at an engagement point 112, and further secured by a guide material engagement bar 113 attached to the lift sheet material 105 by way of an enclosure 114 created near the bottom of guide material 105 specifically for and to secure the engagement bar 113.

Although the shade 102 is described in reference to a window shade or covering, it is to be understood that such a structure can be used in conjunction with any type of opening, including architectural openings such as doors, hatches, portals, entry ways and the like.

FIG. 8 is a representative view of the shade disengaged from the lift sheet material in one embodiment, wherein the same reference numbers identify the same component parts as are shown in FIG. 7. Such disengagement is made easily when the lift sheet 105 with pocket 115 and guide bar 113 are pulled away from the shade 102 and guide member 104 in a direction other than directly upwards. This safety design allows for disengagement should the system be tampered with, and will also disengage when sufficient weight is applied to the lift sheet 105. Otherwise, the lift sheet 105 remains engaged to the shade 102 when being drawn vertically upward by the roller 101.

Figure 9:
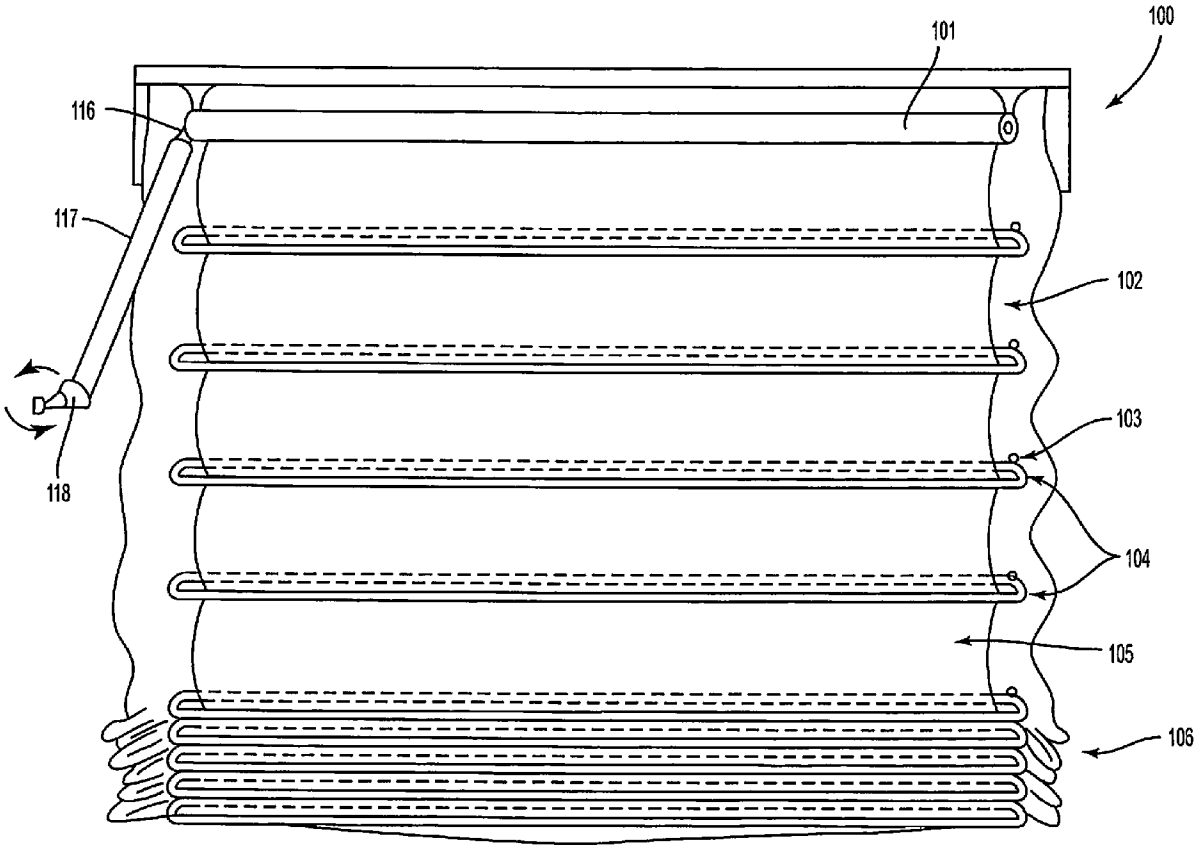
FIG. 9 is a representative side view of another embodiment of the cordless covering system.

FIG. 9 is a representative side view of another embodiment of the cordless covering system, including a support member 100, roller 101, shade 102, guide members 104, and lift sheet material 105. Note that this view depicts the shade 102 partially drawn up with a number of guide members 104, to form a compacted folded conformation 106 as shown.

The cordless covering system of FIG. 9 includes a beaded chain or pull cord 116 for driving a mechanical-based shade retraction/extension assembly. The pull cord or beaded chain 116 in this arrangement is sheathed in a dual or single channel cord enclosure 117, with a crank device 118 is coupled to the cord or chain at the end of the sheathing channel enclosure 117 to enable retraction or extension of the shade 102 by manual cranking manipulation of the crank device 118 to rotate the roller 101.

Thus, in one embodiment, a cover is disclosed that comprises a crank mechanism that is manually actuatable to wind the lift sheet about the roller or to unwind the lift sheet from the roller. Such crank mechanism may be mechanically coupled to the roller for rotation thereof in either of a first rotation direction or a second rotation direction opposite to the first rotation direction. The crank mechanism may be mechanically coupled to the roller by any suitable coupling structure, such as for example a beaded chain that is mounted inside a channel member. The dual or single channel enclosure 117 may take on many forms, including having an exposed cord that ideally won't create a hazardous loop of 12 inches or more in diameter.

Figure 10:
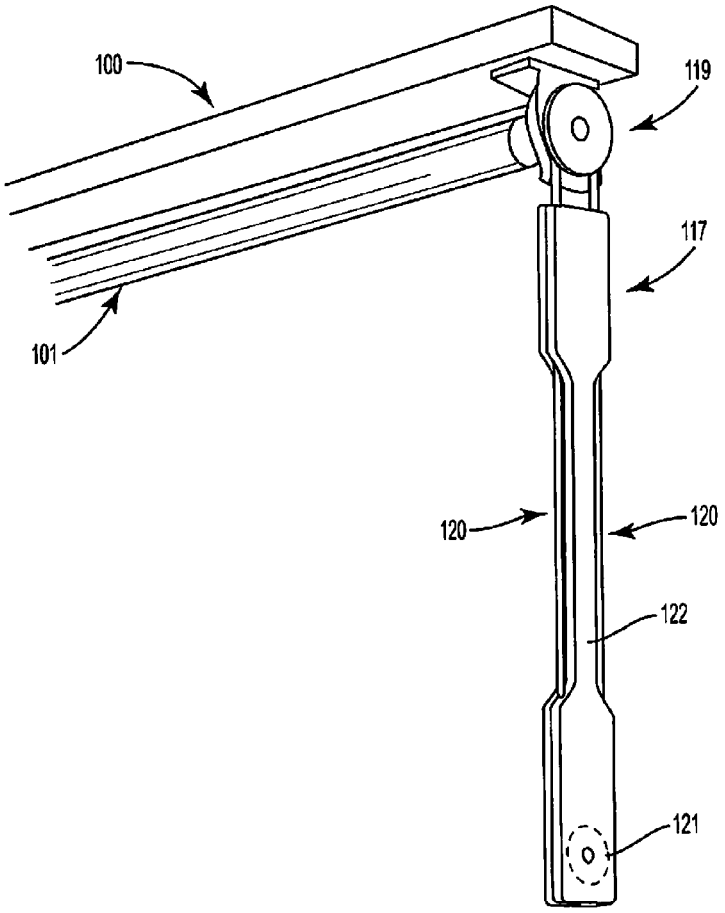
FIG. 10 is a representative view of one embodiment of a sheathed dual channel pull cord enclosure.

Such a system is disclosed in FIG. 10 which is a schematic representation from the side of one embodiment disclosing a sheathed dual channel cord enclosure 117 attached to the roller 101 via a roller mechanism 119. Such a universal or custom fit roller mechanism 119 would allow for retro-fitting of old corded and like systems in addition to adapting to the shade systems of the various embodiments disclosed herein. The roller mechanism 119 is ideally attached to the sheathed dual channel cord enclosure 117 and feeds a draw cord mechanism (or beaded loop chain, string, twine, rope or the like) into the each of the two loop cords tracks 123 (FIGS. 11-13). As used herein, the term "cord" or "cord mechanism" may include chains, such as beaded loop chains, string, twine, rope, or the like. The cords 124 are then exposed 120 in the middle of the sheathed enclosure 117 running generally parallel to the support neck 122 of the sheathed enclosure 117 and back into the loop cord tracks 123 and around a pulley or spring tension mechanism 121 at the bottom of the sheathed enclosure 117. In one embodiment, a weight may be used in place of the spring tension mechanism 121 at the bottom of the sheathed enclosure 117 to retain the cord mechanism at a distal point from the roller mechanism 119. The exposed portions of the cords 120 are pulled tight enough between the upper roller mechanism 119 and lower pulley 121 to keep the cords 120 from being pulled away from the sheathed enclosure to form any hazardous loop. While FIG. 10 discloses a dual channel sheath enclosure 117, a single corded system could also be implemented with the pulley 121 instead being a spring tension mechanism, weight, or roller that rolls up one cord.

FIG. 11 a schematic representation of one embodiment comprising a cross-sectional front inside and back inside view of the sheathed dual channel pull cord enclosure 117 on the left in a detailed cross sectional view and up close in detail below that shows the bottom of the enclosure 117 where the pulley 121 engages the cord 124 as it loops down the loop cord track 123 and around the pulley wheel 121. In addition, FIG. 11 reveals a front-view assembled view on the top right.

FIG. 12 is a representative view of one embodiment of the sheathed dual channel pull cord enclosure 117 at the top in a detailed cross sectional view of each front and back side of the arm with the cord 124 and cord tracks 123. On the right, the enclosure 117 reveals the roller mechanism 119 attached at the top to be engaged with a shade roller 101 to drive the system.

FIG. 13 is a representative view of one embodiment of the sheathed dual channel pull cord enclosure 117 at the bottom in a detailed cross sectional view of each front and back side of the arm with the cord 124 and cord tracks 123 as the cord 124 loops around the pulley 121.

FIG. 14 is a representative view of the assembled dual channel pull cord enclosure 117 with exposed cord 120, support neck 122 that also acts to keep the cord from exposing any hazardous loops, the axle of the pulley 121 at the bottom of the enclosure 117, and the roller mechanism 119 at the top that could ideally be retro-fitted to any prior shade or blind system. In addition, either or both the roller mechanism 119 and the pulley 121 can be spring loaded or spring tensioned mechanisms commonly known in the art, but which are ideally shielded from view by the sheathed enclosure 117. Alternately, a weight may be used in place of the spring tension mechanism.

FIG. 15 is directed towards another embodiment of a cord channel enclosure 126 capable of actuating the lift sheet 105 (shown in FIG. 1) and turn the roller 101 (shown in FIG. 1). In this embodiment, the cord (shown in FIG. 14) is not exposed and is contained entirely within the cord channel enclosure 126. A roller mechanism 128 may be provided on a top portion of the cord channel enclosure 126 for insertion or formed as part of the roller 101. As shall be explained in further detail below, a slider 130 may be movably engaged to the cord channel enclosure 126 so that sliding the slider 130 actuates the roller 101 to lift and lower the lift sheet 105.

FIG. 16 illustrates an exploded view of one embodiment of the roller mechanism 128. The roller mechanism 128 may include first and second body portions 132, 134 and first, second, and third hollowed shafts 136, 138, 140. The first hollowed shaft 136 may be narrower than the second and third hollowed shafts 138, 140 but also longer so that it can be inserted into the second and third hallowed shafts 138, 140. Similarly, the second hollowed shaft 138 may be narrower than the third hollowed shaft but also longer to fit within the third hollowed shaft 140. The third hollowed shaft 140 is inserted into, engages, or is integrated with the roller 101 (shown in FIG. 1) so that turning the third hollowed shaft 140 actuates the lift sheet 105 (shown in FIG. 1). A cord 142, which in this example is a beaded chain, may be inserted within a ring channel 143 in the second hollowed shaft 138. The second hollowed shaft 138 thus acts as a pulley for the cord 142 so that actuating the cord 142 turns the second hollowed shaft. As discussed above, the second hollowed shaft 138 may be inserted within the third hollowed shaft 140 and thus turning the second hollowed shaft 138 also turns the third hollowed shaft 140 to actuate the roller 101. To connect the first, second, and third hollowed shafts 136, 138, 140 to the first body portion 132, the first hollowed shaft 136 defines an engagement end 145 having a lip 147. A ringed enclosure 148 having an opening 150 is provided within an engagement chamber 149 of the first body portion 132. The lip 147 may be inserted through the opening and into the ringed enclosure 148 to thereby connect the first, second, and third hollowed shafts 136, 138, 140. The first, second, and third hollowed shafts 136, 138, 140 may provide sufficient friction to prevent the roller 101 from being turned when the cord 142 is intended to be actuated.

Referring now to FIGS. 16 and 17, the engagement chamber 148 also houses the cord 142 to prevent the cord 142 in the ringed channel 143 from being exposed. The first and second body portion 132, 134, may also each include a pair of guide channels 152 that guide the cord 142 and prevent the cord 142 from becoming tangled. Each of the first and second body portions 132, 134 may also have insertable ends 154, 156. The first and second body portions 132, 134 engage one another and their insertable ends 154, 156, are placed within a first end 158 of the cord channel enclosure 126. In this manner, the cord 142 is not exposed by the roller mechanism 128.

FIG. 18 illustrate a top view of the cord channel enclosure 126 and the slider 130. The slider 130 may have an outside enclosure 160, a housing enclosure 162 contained within the outside enclosure 160 and a sliding member 164 that connects the outside enclosure 160 and housing enclosure 162. The housing enclosure 162 may be divided into a pair of guiding channels 165, 166 that receive the cord 142 (shown in FIG. 17). Furthermore, the cord channel enclosure 126 may define a slit 168 that extends throughout the length of the cord channel enclosure 126. As illustrated in FIG. 19, a portion of the cord channel enclosure 126 may be enclosed by the outside enclosure 160 and the sliding member 164 may be received in the slit 168 to allow for the slider 130 to slide along the cord channel enclosure 126. The housing enclosure 162 may be received in and enclosed by the cord channel enclosure 126.

FIG. 20 illustrates the slider 130 and an exploded view of a cord engagement mechanism 170 that is operably associated with the slider 130 so that sliding the slider 130 along the cord channel enclosure 126 (illustrated in FIG. 18) actuates the cord 142 (illustrated in FIG. 17). The cord engagement mechanism 170 includes a cord engagement member 172 and a cord disengagement component 174 ("the engagement members"). The cord engagement member 172 and the cord disengagement component 174 are contained within the housing enclosure 162 (shown in FIG. 18) after assembly. A connection pin 175 may be inserted through the cord engagement member 172 and the cord disengagement component 174 to couple the components. In other embodiments, the cord engagement member 172 and the cord disengagement component 174 may simply be part of one integrated device.

In this embodiment, an actuating component 176 is received within a depression 178 defined by the slider 130. A shaft 180 connects the actuating component 176 to the cord engagement member 172 and the cord disengagement component 174. In this manner, turning the actuating component 176 clockwise and counterclockwise within the depression 178 also turns the cord engagement member 172 and the cord disengagement component 174.

FIG. 21 illustrates the cord engagement member 172 and the cord disengagement component 174 within the cord channel enclosure 126 along with a separated view of the slider 130 and the actuation component 176 from the cord channel enclosure. As the actuation component 176 is turned, the cord engagement member 172 and the cord disengagement component 174 are also turned within housing enclosure 162 (shown in FIG. 18) of the slider 130 which is inside the cord channel enclosure 126 when the cord channel enclosure 126 has been assembled. In this embodiment, the depression 178 includes engagement members 181A, 181B.

FIG. 22 illustrates the other side of the actuation component 176 which includes oppositely disposed openings 182. The engagement members may be received in the openings 182 so that the engagement members slide in the openings 182 as the actuation component 176 is turned. In this manner, the openings 182 are shaped to define the angular range for turning the actuation component 176 and, as a result, also define the angular range for turning the cord engagement member 172 and the cord disengagement component 174.

FIG. 23 illustrates another embodiment of an actuation component 184 and a slider 186. In this embodiment, a depression 188 in the slider 186 defines oppositely disposed fan shaped openings 190. FIG. 24 illustrates the other side of the actuation component 184 that defines oppositely disposed turning members 192. The turning members 192 may be placed within and slide within the fan shaped openings 190 as the actuation member 184 is turned. In this manner, the fan shaped openings 190 may be shaped to define the angular range for turning the actuation component 184 and, as a result, also define the angular range for turning the cord engagement member 172 and the cord disengagement component 174.

Referring now to FIG. 25, the cord engagement member 172 may be turned to engage the cord 142 so that sliding the slider 130 (shown in FIG. 19) along the cord channel enclosure 126 (shown in FIG. 19) actuates the cord 142. As mentioned above, the cord engagement member 172, the cord disengagement component 174, and the cord 142, may be provided within the housing enclosure 162 (shown in FIG. 19) when the cord channel enclosure 126 is assembled. In this embodiment, the angular range of the cord engagement member 172 and the cord disengagement component 174 is about 5° in either direction. The angular range however may vary in other embodiments depending on factors such as the particular dimensions of the cord channel enclosure 126 and slider 130 or regulatory and standardization requirements. To engage the cord 142, the cord engagement member 172 includes an engagement end 193 which shall be described in further detail below. In this embodiment, the cord 142 is turned clockwise by turning the cord engagement member 172 to the right and sliding the cord engagement member 172 and the cord disengagement component 174 in a downward direction. On the other hand, the cord 142 is turned counterclockwise by turning the cord engagement member 172 to the left and sliding the cord engagement member 172 downward. Also, the engagement end 193 in this embodiment of the cord engagement member 172 has an anvil shape. This may be advantageous when the cord 142 is beaded since this allows that the engagement end to be disengaged by sliding the cord engagement member 172 in an upwardly direction.

The cord disengagement component 174 may also disengage the engagement end 193 from the cord 142 and also serve to snap the cord engagement member 172 and the actuation component 176 (shown in FIG. 18) to a release position after turning the cord 142. The cord disengagement component 174 may include oppositely disposed elastic members 194, 196. When the cord engagement member 172 is turned in one direction, the cord disengagement component 174 may be turned in the opposite direction, thus creating tension in one of the elastic members 194, 196. When the actuation component 176 is released, the tension in the elastic member 194, 196 disengages the engagement end 193 from the cord 142 and may also be utilized to place the cord engagement member 172 and the actuation component 176 in the release position.

FIG. 26 is a top view of the cord engagement member 172. As illustrated, the engagement end 193 of the cord engagement member 172 may include a pair of oppositely disposed slots 198, 200 to engage the cord 142 (shown in FIG. 25).

FIG. 27 illustrates an embodiment of end structures 202, 204 that may be inserted into a second end 206 of the cord channel enclosure 126. When the end structures 202, 204 engage one another, oppositely disposed guiding channels 208, 210 are formed. FIG. 28 illustrates a cross sectional view of the cord channel enclosure 126 with the cord 142 being guided within the guiding channels 208, 210.

In general, it may be desirable to have the lift sheet be a single panel article as opposed to vertically extending multiple strips laterally spaced apart from one another, since in the latter instance, the strips may bunch or otherwise become intertwined with one another, and may pose a safety hazard if a small child's arm or neck becomes entangled by such strips, if they are not arranged in a "breakaway" or disengageable relationship to the cover of the shade assembly. It typically is preferred to have the lift sheet extend laterally across a substantial portion of the back of the cover, and to have the lift sheet arranged for such breakaway disengagement of the lower end portion of the lift sheet from the cover.

Such laterally extended character of the lift sheet serves another purpose, of protecting the back of the decorative shade material, when the cover is formed of such material. This in turn can permit the cover to be "liner-less" since a lining layer of sheet material is not required, if the lift sheet extends substantially across the full extent of the cover.

In various embodiments, it is preferred to utilize guide members that extend only partly inwardly in a lateral direction, so that the guide members are arranged to "wrap around" the edge portions of the lift sheet, as shown in FIG. 5 hereof.

It will therefore be recognized that embodiments of the cordless shade system disclosed herein can be constructed and arranged in any suitable manner, e.g., with a decorative sheet suspended or suspendable from a support and secured at its lower end portion to a lower end portion of a lifting sheet that is joined at its upper end to a lifting and lowering apparatus, with guide structure that couples the decorative sheet with the lifting sheet so as to enable the lifting sheet during lifting thereof to compact the decorative sheet into an upwardly compacted form, and during lowering thereof to release the decorative sheet from its upwardly compacted form to a downwardly extending sheet conformation.

Further, when the cordless shade system is deployed in a window, door or other opening, the lifting sheet itself may be decoratively appointed with a design, pattern, appliqué, silk-screened image, logo or other visual indicia, so that both faces of the shade system have an aesthetic or otherwise suitable visual appearance.

Although the embodiments disclosed herein have been illustratively described with respect to various embodiments for window openings or other architectural openings, it will be recognized that the cover assembly can be advantageously utilized as a covering for any indoor or outdoor passage, portal, gate opening or the like. For example, the cover assembly in other embodiments can be used as a closure for a tent or cabana or a decorative screen or partition that may be deployed with an associated frame, to provide a freestanding room divider, privacy screen, sun-blocking structure or the like.

While the embodiments disclosed herein have been described herein in reference to specific aspects, features and illustrative embodiments, it will be appreciated that the utility of the invention is not thus limited, but rather extends to and encompasses numerous other variations, modifications and alternative embodiments, as will suggest themselves to those of ordinary skill in the field of the present invention, based on the disclosure herein. Correspondingly, the invention as hereinafter claimed is intended to be broadly construed and interpreted, as including all such variations, modifications and alternative embodiments, within its spirit and scope.

Those skilled in the art will recognize improvements and modifications to the preferred embodiments of the present disclosure. All such improvements and modifications are considered within the scope of the concepts disclosed herein and the claims that follow.

What is claimed is:

1. An apparatus for actuating an architectural covering comprising:

an enclosure configured to receive a cord mechanism, the cord mechanism adapted to be positioned in a loop having a first side and a second side;

a roller mechanism provided on an end of the enclosure, wherein the roller mechanism is configured to be inserted into a roller adapted to lift or lower the architectural covering;

a slider configured to be movably engaged to the enclosure so that moving the slider actuates the roller mechanism to lift or lower the architectural covering; and a cord engagement mechanism operably associated with the slider, wherein the cord engagement mechanism is positioned in between the first side and the second side of the cord mechanism and has a first engagement end and a second engagement end, wherein the first and second engagement ends are curved downward to selectively engage the first and second sides of the cord mechanism as the slider is moved.

2. The apparatus of claim 1 wherein the enclosure is further configured to completely enclose the cord mechanism.

3. The apparatus of claim 1 wherein the roller mechanism is formed as part of a roller adapted to lift or lower the architectural covering.

4. The apparatus of claim 1, wherein the enclosure further comprises a slit that extends through a length of the enclosure that allows the slider to slide along the enclosure.

5. The apparatus of claim 1, wherein at least one of the first engagement end and the second engagement end is anvil shaped.

6. The apparatus of claim 1, wherein the cord mechanism comprises a beaded chain.

7. The apparatus of claim 1, wherein the cord disengagement component is configured to disengage the engagement end from the cord mechanism.

8. The apparatus of claim 7, wherein the cord disengagement component is configured to snap the cord engagement member and the actuating component to a release position.

9. The apparatus of claim 1, wherein the slider further comprises an outside enclosure.

10. The apparatus of claim 9, wherein the slider further comprises a housing enclosure contained within the outside enclosure.

11. The apparatus of claim 10, wherein the slider further comprises a sliding member that connects the outside enclosure and the housing enclosure.

12. The apparatus of claim 10, wherein the housing enclosure is divided into a plurality of guiding channels configured to receive the cord mechanism.

13. The apparatus of claim 11, wherein a portion of the enclosure is enclosed by the outside enclosure, and wherein the sliding member is configured to be received by a slit that extends through a length of the enclosure.

14. The apparatus of claim 1, wherein the cord engagement mechanism comprises a cord engagement member and a cord disengagement component.

15. The apparatus of claim 14, further comprising an actuating component operably connected to the cord engagement member and the cord disengagement component.

16. The apparatus of claim 15, wherein the actuating component comprises at least one opening configured to receive at least one of the cord engagement member and the cord disengagement component.

17. The apparatus of claim 16, wherein the at least one opening is shaped to define an angular range for turning the actuating component.

18. The apparatus of claim 17, wherein the at least one opening is shaped to define the angular range to be approximately five (5) degrees.

19. The apparatus of claim 1 wherein the roller mechanism further comprises a first body portion and a second body portion.

20. The apparatus of claim 19, wherein at least one of the first body portion and the second body portion comprises at least one channel configured to guide the cord mechanism to prevent the cord mechanism from becoming tangled.

21. The apparatus of claim 19, wherein the first body portion and the second body portion each comprise an insertable end that are configured to be inserted into an end of the enclosure such that the cord mechanism is not exposed by the roller mechanism.

22. The apparatus of claim 19 wherein the roller mechanism further comprises a plurality of hollowed shafts.

23. The apparatus of claim 22, wherein at least one of the plurality of hollowed shafts is configured to be engaged with a roller adapted to lift or lower the architectural opening such that turning the at least one of the plurality of hollowed shafts actuates the architectural covering.

24. The apparatus of claim 22, wherein the plurality of hollowed shafts are configured to provide sufficient friction to prevent a roller coupled to the roller mechanism from being actuated.

25. The apparatus of claim 22 wherein at least one of the plurality of hollowed shafts is narrower than at least one other hollowed shaft of the plurality of hollowed shafts.

26. The apparatus of claim 25 wherein the at least one of the plurality of hollowed shafts is longer than the remaining ones of the plurality of hollowed shafts so that the at least one of the plurality of hollowed shafts can be inserted into at least one of the other hollowed shafts of the plurality of hollowed shafts.

27. The apparatus of claim 22, wherein at least one of the plurality of hollowed shafts comprises a channel configured to receive a cord mechanism.

28. The apparatus of claim 27, wherein the at least one of the plurality of hollowed shafts is configured to act as a pulley for the cord mechanism such that actuating the cord mechanism turns the at least one of the plurality of hollowed shafts.

29. A method of making an apparatus for actuating an architectural covering comprising:

providing an enclosure configured to receive a cord mechanism, the cord mechanism adapted to be positioned in a loop having a first side and a second side;

attaching a roller mechanism to an end of the enclosure, wherein the roller mechanism is configured to be inserted into a roller adapted to lift or lower the architectural covering;

coupling a slider to the enclosure such that moving the slider actuates the roller mechanism to lift or lower the architectural covering; and operably associating a cord engagement mechanism with the slider, wherein the cord engagement mechanism is positioned in between the first side and the second side of the cord mechanism and has a first engagement end and a second engagement end, wherein the first and second engagement ends are curved downward to selectively engage the first and second sides of the cord mechanism as the slider is moved.

30. The method of claim 29, further comprising providing the enclosure with a slit that extends through a length of the enclosure that allows the slider to slide along the enclosure.

31. The method of claim 29, further comprising providing the cord engagement mechanism as a cord engagement member and a cord disengagement component.

32. The method of claim 29, wherein at least one of the first engagement end and the second engagement end is anvil shaped.

33. The method of claim 29, wherein the cord mechanism comprises a beaded chain.

34. The method of claim 29, further comprising forming the roller mechanism to include a first body portion and a second body portion.

35. The method of claim 34, further comprising forming the first body portion and the second body portion to each include an insertable end configured to be inserted into an end of the enclosure such that the cord mechanism is not exposed by the roller mechanism.

36. The method of claim 29, further comprising forming the roller mechanism as part of a roller adapted to lift or lower the architectural covering.

37. The method of claim 36, wherein forming the roller mechanism further comprises forming a plurality of hollowed shafts, and the method further comprises inserting at least one hollowed shaft of the plurality of hollowed shafts into at least one other hollowed shaft of the plurality of hollowed shafts.

38. The method of claim 37, wherein the plurality of hollowed shafts are configured to provide sufficient friction to prevent a roller coupled to the roller mechanism from being actuated.

39. The method of claim 29, further comprising providing an actuating component configured to be operably connected to the cord engagement member and the cord disengagement component.

40. The method of claim 39, further comprising providing the actuating component with at least one opening configured to receive at least one of the cord engagement member and the cord disengagement component.

41. The method of claim 40, further comprising shaping the at least one opening to define the angular range for turning the actuating component.

42. The method of claim 29, further comprising forming the slider to include an outside enclosure.

43. The method of claim 42, further comprising forming the slider to include a housing enclosure contained within the outside enclosure.

44. The method of claim 43, further comprising forming the slider to include a sliding member that connects the outside enclosure and the housing enclosure.

45. The method of claim 43, further comprising dividing the housing enclosure into a plurality of guiding channels configured to receive the cord mechanism.

46. The method of claim 43, wherein a portion of the enclosure is enclosed by the outside enclosure, and wherein the sliding member is configured to be received by a slit that extends through a length of the enclosure.

* * * * *